United States Patent [19]

Shirakawa et al.

[11] 4,380,869

[45] Apr. 26, 1983

[54] ELECTRIC SHAVER OF RECIPROCATING DRIVE TYPE HAVING TRIMMER BLADE

[75] Inventors: Kenzo Shirakawa; Masao Matsumoto; Shinsaku Yasunaka, all of Hikone, Japan

[73] Assignee: Matsushita Electric Works, Ltd., Kadoma, Japan

[21] Appl. No.: 261,278

[22] Filed: May 6, 1981

[30] Foreign Application Priority Data

May 15, 1980 [JP] Japan ..... 55-64930

[51] Int. Cl.[3] ..... B26B 19/10

[52] U.S. Cl. ..... 30/34.1

[58] Field of Search ..... 30/34.1

[56] References Cited

U.S. PATENT DOCUMENTS

| | | | |
|---|---|---|---|
| 3,967,372 | 7/1976 | Beck | 30/34.1 |
| 3,991,464 | 11/1976 | Ihasz | 30/34.1 |
| 3,997,967 | 12/1976 | De Boer | 30/34.1 |
| 4,283,848 | 8/1981 | Messinger | 30/34.1 |

FOREIGN PATENT DOCUMENTS

| | | | |
|---|---|---|---|
| 54-6648 | 1/1979 | Japan | 30/34.1 |
| 54-100866 | 8/1979 | Japan | 30/34.1 |

*Primary Examiner*—Jimmy C. Peters

*Attorney, Agent, or Firm*—Birch, Stewart, Kolasch & Birch

[57] ABSTRACT

An electric shaver of a reciprocating drive type having a trimmer blade comprises a housing and an outer blade frame detachably mounted onto the upper portion of the housing. A trimmer blade assembly is mounted to the housing so as to be protrusile outward of the housing. A switch plate is provided on the housing so that three stop positions may be selectively assumed, in which the third position is allotted to enable the trimmer blade assembly to be protruded in cooperation with a trimmer lever, while a driving force is afforded to both the main blade and the trimmer blade assembly. A cleaning operation portion is further provided on the housing so that the same may be operated independently of the switch plate. The cleaning operation portion acts on the trimmer lever to enable the trimmer blade assembly to be protruded outward, with the same in an intact state of not being driven by a motor. The outer blade frame can be removed from the housing at the same time in response to the operation of the cleaning operation portion.

10 Claims, 35 Drawing Figures

ELECTRIC SHAVER OF RECIPROCATING DRIVE TYPE HAVING TRIMMER BLADE

BACKGROUND OF THE INVENTION

1. Field of the Invention

The present invention generally relates to an electric shaver of a reciprocating drive type having a trimmer blade. More specifically, the present invention relates to an electric shaver of a reciprocating drive type having a trimmer blade adapted such that the trimmer blade may be protruded outward of a housing when the same is used.

2. Description of the Prior Art

An electric shaver having a trimmer blade apart from and in addition to a main blade has been conventionally well-known. One example of such electric shaver is disclosed in U.S. Pat. No. 4,167,060, issued Sept. 11, 1979 to Sakamoto. On the occasion of using such electric shaver as disclosed in the above referenced patent, a trimmer blade is protruded outward of a housing. Conventionally such type of electric shaver was structured such that a trimmer blade is protruded outward of a housing while a movable blade constituting the same is necessarily driven, due to structural restriction. On the other hand, it is difficult to clean a trimmer blade using a brush, for example, unless the trimmer blade is brought to a state of being protruded outward of the housing. Therefore, when a trimmer blade of a conventional electric shaver is cleaned, it follows that the end portions of bristles of the brush are undesirably cut with the trimmer blade, with the result that it is extremely difficult to clean such trimmer blade.

SUMMARY OF THE INVENTION

In brief, the present invention comprises an electric shaver which comprises two operation portions which act on a trimmer blade assembly mounted to be protrusile outward of a housing which can be individually operated. Upon operation of one operation portion the trimmer blade assembly is protruded outward of the housing while the same is subject to a driving force of a motor, whereas upon operation of the other operation portion the trimmer blade assembly is merely protruded outward of the housing, without a driving force being transmitted thereto. Therefore, according to the present invention, the trimmer blade assembly can be protruded even in an intact state of not being subject to a driving force. Accordingly, even in the case where hair dust attached to the trimmer blade assembly is to be cleaned using a brush, for example, the end portions of the bristles of the brush are not damaged, with the result that the trimmer blade assembly can be cleaned with ease.

In a preferred embodiment of the present invention, upon operation of the above described other operation portion, an outer blade frame can be removed from the housing. Conversely described, the outer blade frame cannot be removed from the housing unless the other operation portion is operated, with the result that the outer blade frame is not removed erroneously from the housing. According to the embodiment being described, another advantage is brought about wherein upon operation of only the other operation portion not only the trimmer blade assembly but also the outer and inner blades can be cleaned.

In another preferred embodiment of the present invention, a holding member for holding the outer blade frame to the housing is formed integrally of the other operation portion so that protrusion of the trimmer blade assembly and removal of the outer blade frame from the housing can be achieved in an associated manner in response to the operation of the above described other operation portion. The embodiment described is structured such that on the occasion of fitting the outer blade frame to the housing the transmission of the force in one direction is interrupted so that the force exerted upon the holding member by the outer blade frame may not be transmitted to the other operation portion. Therefore, according to the embodiment being described, an advantage is brought about wherein the trimmer blade assembly is not protruded outward undesirably on the occasion of mounting the outer blade frame.

Accordingly, a principal object of the present invention is to provide an electric shaver of a reciprocating drive type having a trimmer blade, wherein a trimmer blade can be brought to a state of being protruded outward without the same being driven.

Another aspect of the present invention resides in an electric shaver, wherein a trimmer blade as well as a main blade can be cleaned with ease.

A further aspect of the present invention resides in an electric shaver, wherein an outer blade frame is not undesirably removed from a housing.

Still a further aspect of the present invention resides in an electric shaver, in which a trimmer blade is not undesirably protruded outward in mounting an outer blade frame to a housing, in the case where the electric shaver is adapted such that removal of the outer blade frame from the housing and protrusion of the trimmer blade outward are associated.

These objects and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
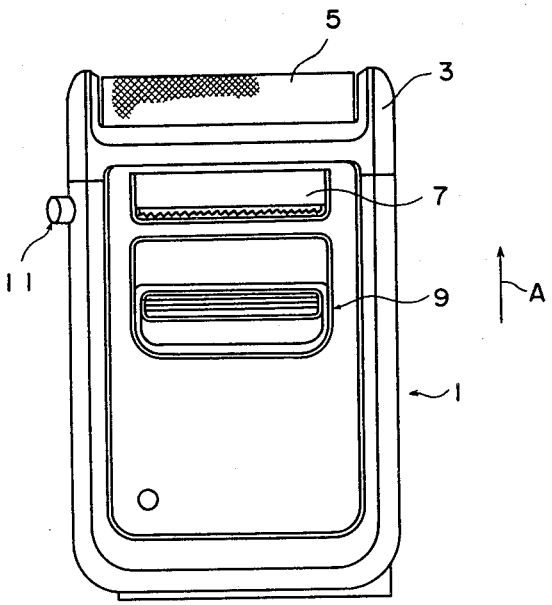
FIG. 1 is a front view showing an appearance of one embodiment of the present invention.
Figure 2:
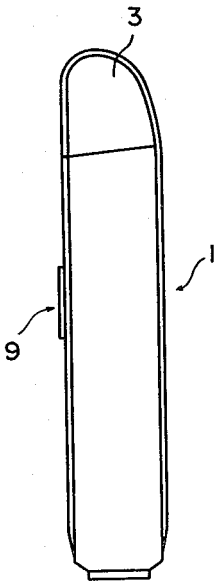
FIG. 2 is a right side view of the FIG. 1 embodiment.

FIG. 1 is a front view showing an appearance of an electric shaver of a reciprocating drive type having a trimmer blade in accordance with one embodiment of the present invention. FIG. 2 is a right side view of the FIG. 1 embodiment. First referring to FIGS. 1 and 2, an outline of the present invention will be described.

The electric shaver shown comprises a housing 1. An outer blade frame 3 is mounted onto the top of the housing 1, while an outer blade 5 is maintained in the outer blade frame 3. An inner blade assembly, not shown and to be described subsequently, is provided inside the outer blade 5 so as to be in contact with the inner surface of the outer blade 5. A trimmer blade assembly 7 is mounted on the front surface of the housing 1 so that the edge thereof may be protrusile/retractile. The housing 1 is further provided with a switch plate 9, such that the same is slidable in the arrow A direction to selectively assume any one of three stop positions. A cleaning operation portion 11 of one essential feature of the embodiment is provided on the side of the housing 1. The operation portion 11 is used in cleaning the trimmer blade assembly 7 with a brush and/or in cleaning the outer blade 5 and the inner blade.

Although it is not shown in FIGS. 1 and 2 and is described subsequently, one end of a trimmer lever (FIG. 14) is coupled to the trimmer blade assembly 7, whereby the trimmer blade assembly 7 is selectively brought to a position retracted toward the housing 1 and the position protruded outward by means of the trimmer lever. The cleaning operation portion 11 is provided so as to be exposed from a part of the side surface of the housing 1, so that the same may be depressed into the housing 1.

Figure 3:
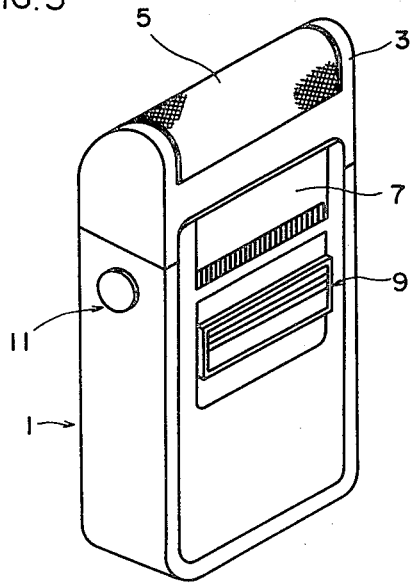
FIGS. 3 to 5 are perspective views showing the respective states of the FIG. 1 embodiment for briefly depicting an operation of the embodiment.
Figure 4:
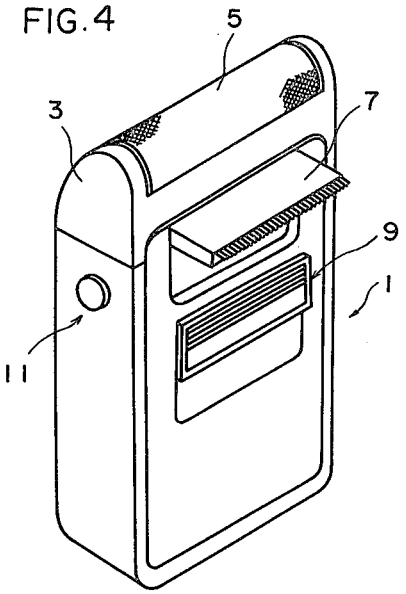
Figure 5:
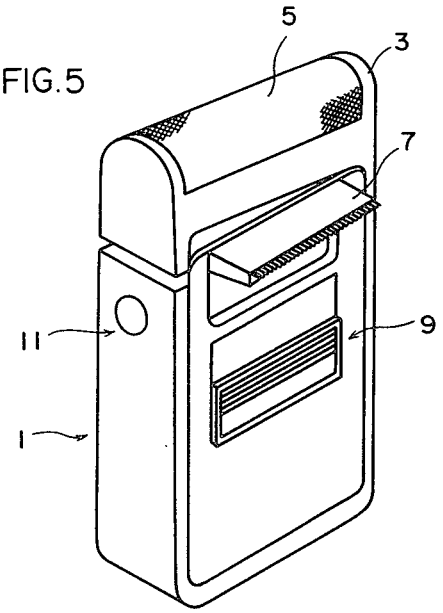

Now referring to FIGS. 3 to 5, an operation of the electric shaver shown will be briefly described. A power supply of a prime mover such as an electric motor is interrupted when the switch plate 9 is brought to the first position (the state shown in FIG. 1). Accordingly, neither the inner blade assembly nor the trimmer blade assembly 9 is driven. Then in the case of the second position of the switch plate 9 (the state shown in FIG. 3), a power supply of the motor is turned on, whereby only the inner blade assembly (not shown) is driven to enable shaving by means of the inner blade assembly and the outer blade 5. In the case of the third position of the switch plate 9, as shown in FIG. 4, the trimmer blade assembly 9 can be maintained as protruded outward of the housing 1, while the inner blade assembly is driven. In such a state the trimmer blade assembly 7 is simultaneously driven in association with driving of the inner blade assembly.

The cleaning operation portion 11 is adapted to act on the trimmer lever for moving the trimmer blade assembly 7. Accordingly, as shown in FIG. 5, upon operation or depression of the cleaning operation portion 11, the trimmer lever is actuated so that the trimmer blade assembly 7 is protruded outward of the housing 1 even in the first position of the switch plate 9. At the same time, the housing 1 and the outer blade frame 3 are separated, as shown in FIG. 5, through operation of the operation portion 11, whereby the outer blade frame 3 can be removed from the housing 1. Accordingly, at the same time not only the trimmer blade assembly 7 but also both the outer blade 9 and the inner blade can be cleaned using a brush, for example.

Figure 6:
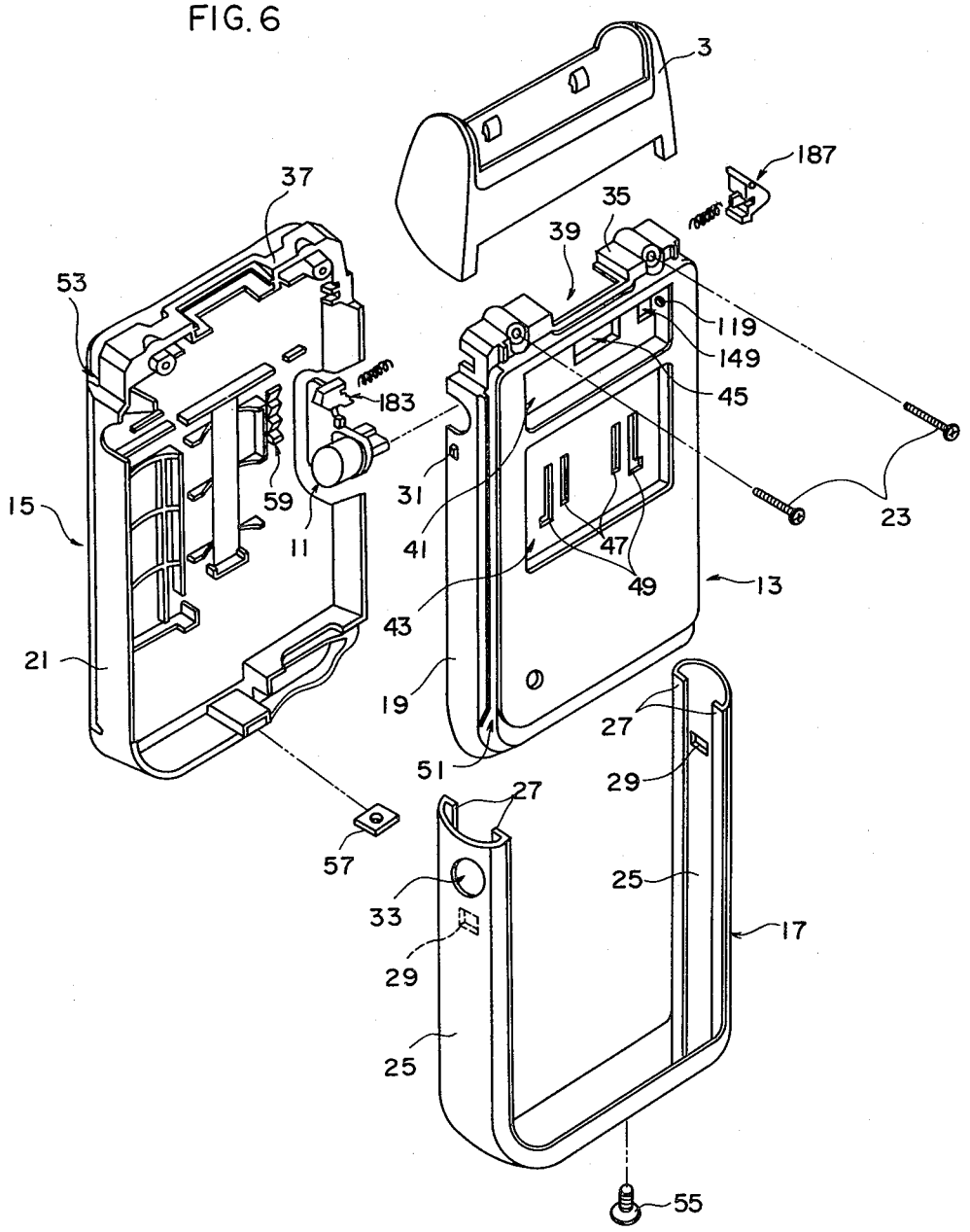
FIG. 6 is a perspective view showing mainly the detail of a disassembled state of the housing structure of the embodiment shown.

FIG. 6 is a perspective view of a disassembled state of the embodiment, particularly showing the housing portion and those associated therewith. It is to be noted that in FIG. 6 and the figures et seq those portions of less importance in description of the embodiment have not been referred to for simplicity of description.

The housing 1 (FIG. 1) comprises two half shell bodies 13 and 15 and a U letter shaped outer frame 17. More specifically, the respective half shell bodies 13 and 15 are each formed by molding synthetic resin, for example, to comprise a rectangular plate portion and side portions 19 and 21 extending from the periphery of the plate portion. The respective side portions 19 and 21 of the two half shell bodies 13 and 15 are abutted and both are integrally united by fastening screws 23 at the upper portion thereof. The U letter shaped outer frame 17 is also formed by molding synthetic resin, for example, so as to be C letter shaped in traverse section. The U letter shaped outer frame 17 comprises side frames 25 each having edges 27 at both sides throughout the full length thereof so as to extend or protrude to each other to constitute the C letter shape. Recesses 29 are formed at proper positions on the inner surfaces of the side frames 25 of the U letter shaped outer frame 17. The recesses 29 are allotted for an elastic fitting with protrusions 31 formed on both sides 19 of one half shell body 13. An aperture 33 is formed on one side frame 25 of the U letter shaped outer frame 17 for the cleaning operation portion 11.

Notches are formed at the upper ends 35 and 37 of the half shell bodies 13 and 15 for the formation of an opening 39 through coordination thereof. A coupling shaft (FIG. 7) for affording a driving force to the inner blade assembly (not shown) can be protruded upward of the housing 1 through the opening 39, as to be described subsequently.

Two recesses 41 and 43 are formed on the plate portion of the front half shell body 13 constituting the housing 1 (FIG. 1). One recess 41 is allotted for receiving the trimmer blade assembly 7 (FIG. 1) therein and the other recess 43 is allotted for slidably receiving the switch plate 9 (FIG. 1) therein. An aperture 45 is formed at the upper central portion of the recess 41 so that a coupling member for transmitting a driving force to the trimmer blade assembly 7 can extend outward of the housing 1 therethrough. A pair of slits 47 and a pair of guide grooves 49 are also formed in the recess 43. The pair of slits 43 are allotted for slidably holding the switch plate 9. The pair of guide grooves 49 are allotted for maintaining and guiding a lock button (FIG. 15) to be described subsequently. An aperture 149 for coupling the trimmer blade assembly 7 and the trimmer lever (FIG. 14) is further formed in the recess 41. A hole 119 is formed at the side wall of the recess 41 for a rotation shaft (FIG. 17) of the trimmer blade assembly 7. Engaging grooves 51 and 53 are formed on the side portions 19 and 21 of the front and rear half shell bodies 13 and 19, respectively.

The housing 1 is assembled in the following manner. The edges of the side portions 19 and 21 of the half shell bodies 13 and 15 are abutted and both are fastened at the upper portion thereof with the screws 23. The edges 27 of the U letter shaped outer frame 17 are then fitted into the engaging grooves 51 and 53 of the integrally united half shell bodies 13 and 15. Accordingly, the abutting portion of the side portions 19 and 21 of the half shell bodies 13 and 15 are covered with the U letter shaped outer frame 17. Thus, any dust and dirt are effectively prevented from entering into the housing 1 through any gap that could occur through abutting of the side portions 19 and 21 of the half shell bodies 13 and 19. Since the protrusions 31 formed on the side portion 19 of the front shell body 13 are elastically fitted into the recesses 29 of the U letter shaped outer frame 17, the U letter shaped outer frame 17 is fixed to a desired position of the half shell bodies 13 and 15. Then a screw 55 is threaded from the bottom portion of the U letter shaped outer frame 17. The screw 55 is threaded with a nut 57 housed at the bottom of the rear half shell body 15 and thus the U letter shaped outer frame is fixed to the united half shell bodies 13 and 15 by means of the screw 55 and the nut 57.

The outer blade frame 3 is mounted onto the top of the housing thus assembled. At that time tip ends of two lock pins 183 and 187 are fitted into a recess, not shown, formed at a predetermined position on the inner surface of the outer blade frame 3. Accordingly, the outer blade frame 3 can be integrally united to the housing 1 by means of lock pins 183 and 187.

Meanwhile, a serration 59 is formed on the inner surface of the plate portion of the rear half shell body 15 so as to be engageable with a ball associated with a switch lever (FIG. 13) to be described subsequently. Three concaves are formed in the serration 59 so that the switch lever and thus the switch plate can be selectively stopped to any of the three postions in a click stop manner through cooperation of the ball and these three concaves.

Since the structural features of the housing of the electric shaver in accordance with the embodiment shown were described in detail in the foregoing, more detailed structure and operation of the inside of the housing will be described in more detail with reference to FIGS. 7 to 22.

Figure 7:
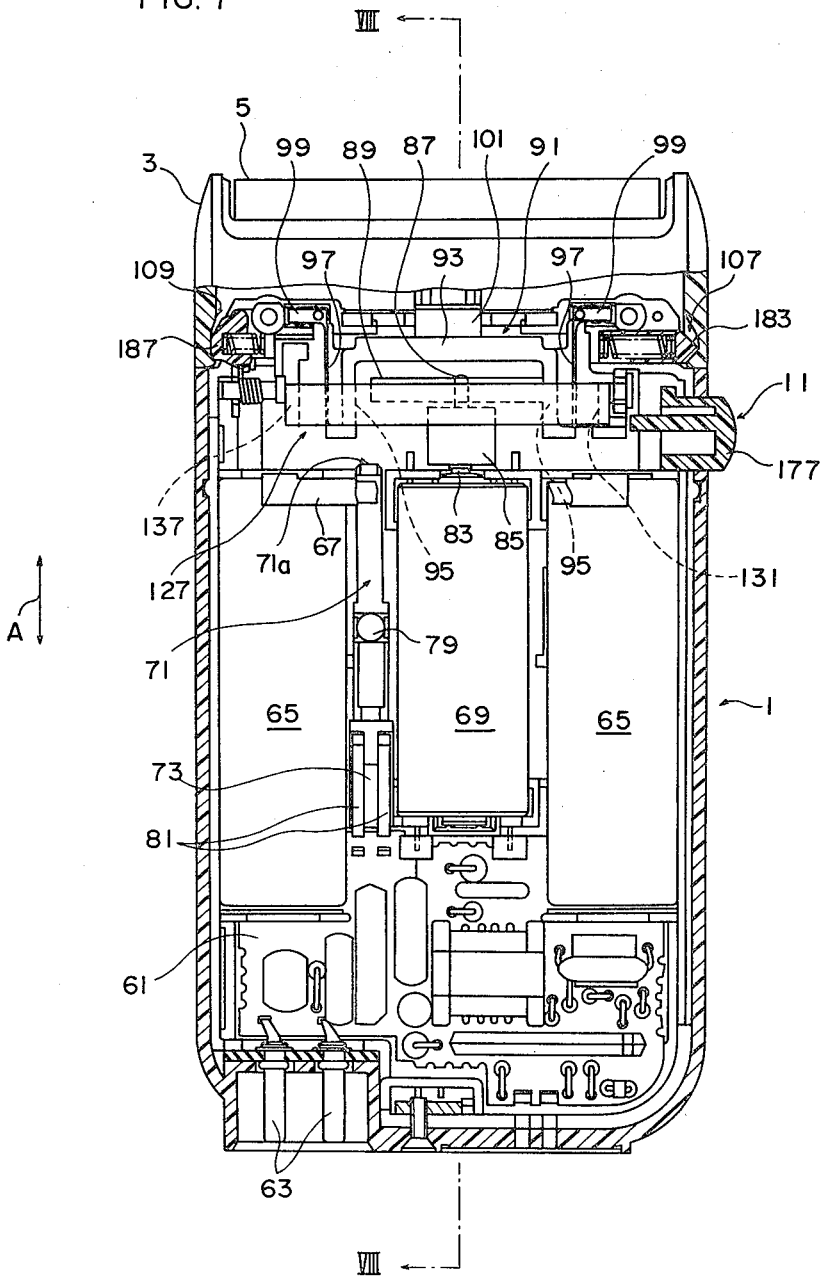
FIG. 7 is a front view, partially fragmentary, for depicting the structure inside the housing.
Figure 8:
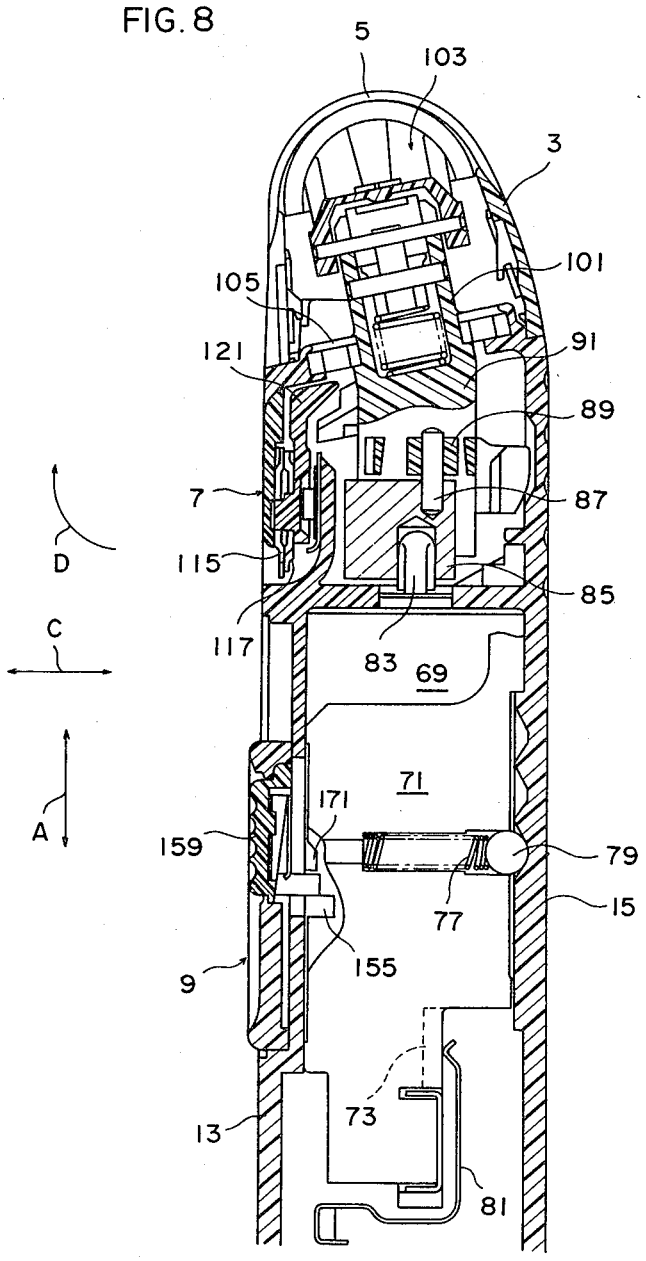
FIG. 8 is a sectional view, partially simplified, taken along the line VIII—VIII in FIG. 7.
Figure 9:
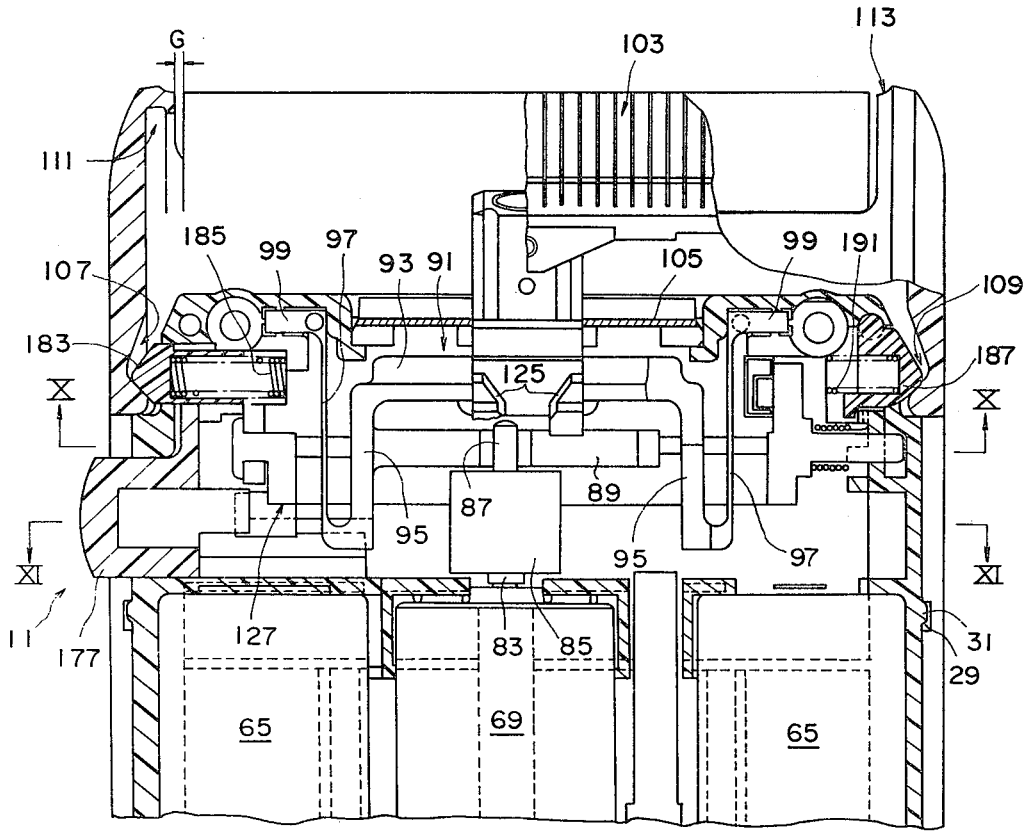
FIG. 9 is an enlarged front view, partially fragmentary, showing the major portion of the embodiment shown.
Figure 10:
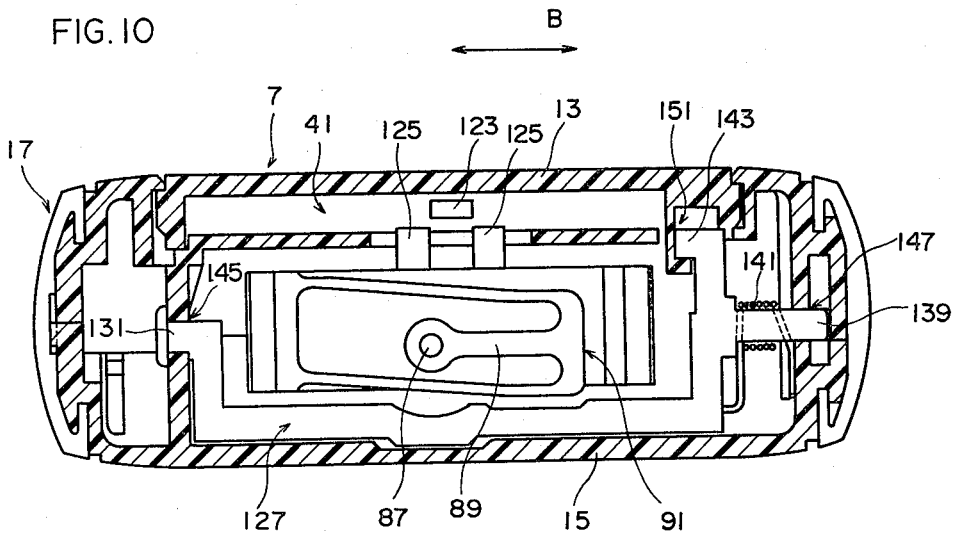
FIG. 10 is a sectional view taken along the line X—X in FIG. 9.
Figure 11:
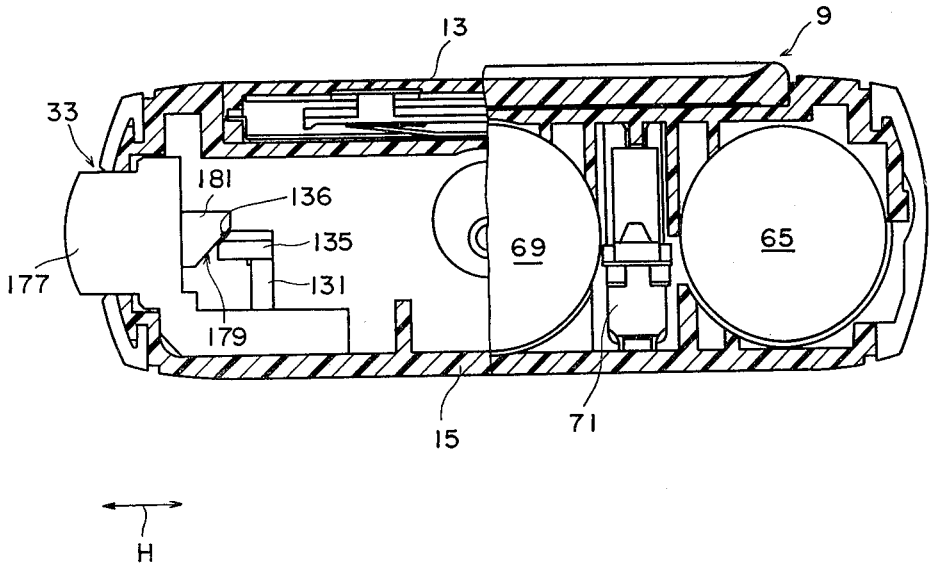
FIG. 11 is a sectional view taken along the line XI—XI in FIG. 9.

FIG. 7 is a front view, partially fragmentary, of the electric shaver in accordance with the embodiment shown, FIG. 8 is a sectional view taken along the line VIII—VIII in FIG. 7, FIG. 9 is an enlarged front view, partially fragmentary, showing the detail of the upper portion of the electric shaver, FIG. 10 is a sectional view taken along the line X—X in FIG. 9, and FIG. 11 is a sectional view taken along the line XI—XI in FIG. 9.

Figure 12:
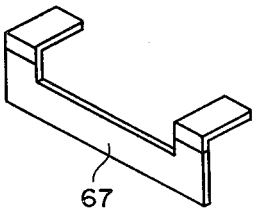
FIG. 12 is a perspective view showing a conductive plate.

A charging base board 61 is housed in the housing 1 at the lower portion. A variety of components constituting a charging circuit are disposed on the charging base board 61 and are electrically connected together. A pair of plug pins 63 are connected to the charging base board 61. The plug pins 63 are allotted for the supply of electric power from an alternating current power supply, not shown, to the charging base board 61. Recharging batteries 65 are housed at both side portions in the housing 1 at the upper portion of the charging base board 65. The rechargeable batteries 65 are connected in series by means of a conductive plate 67 as shown in FIG. 12. A motor 69 is housed and fixed in the housing 1 at the central position between the rechargeable batteries 65. The motor 69 is connected to be energized with an output voltage of say 3 volts from the above described two series connected rechargeable batteries 65. A switch lever 71 is provided in the vicinity of the motor 69. The switch lever 71 is provided to be displacable in the arrow A direction in association with the switch plate 9 (FIG. 1) exposed outside the housing 1.

Figure 13:
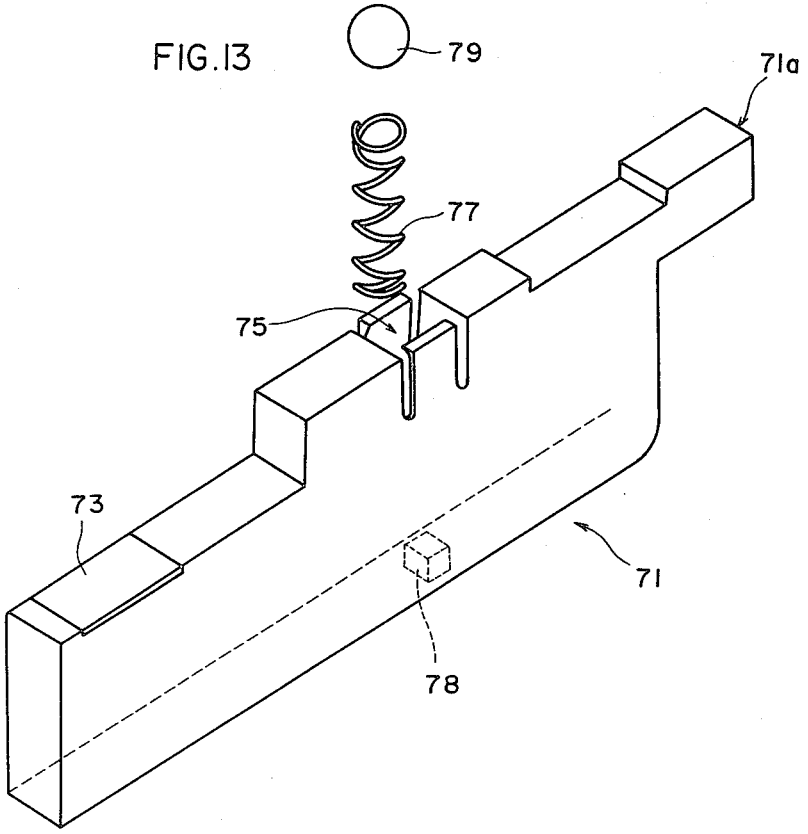
FIG. 13 is a perspective view showing a switch lever.

The switch lever 71 is structured as shown in FIG. 13 and is disposed such that the tip end 71*a* thereof may act on a trimmer lever 97 (to be described subsequently) at the third position of the switch plate 9. A contact plate 73 is provided at the lower end portion of the switch lever 71. The contact plate 73 serves to connect two contacts 81 at the second and third positions of the switch plate 9, thereby to start a supply of an electric power from the rechargeable batteries 65 to the motor 69. A spring receiving portion 75 is formed approximately at a central portion thereof in the longitudinal direction and a coil spring 77 is received in the spring receiving portion 75. A ball 79 is held at the tip end of the coil spring 77. Accordingly, the ball 79 is elastically urged toward the rear half shell body 15 (FIG. 6) by means of the coil spring 77. Therefore, the ball 79 is fittingly engaged with each of the concaves of the serration 59 (FIG. 6) formed on the inner surface of the rear half shell body 15. Thus, the ball 79 moves along the serration from concave to concave as the switch plate 9 (FIG. 1) is displaced in the arrow A direction, while the switch plate 9 assumes any one of the three positions where the ball 79 is fitted into each of the concaves of the serration 59. Meanwhile a concave 78 engageable with a foot piece (FIG. 15) of the switch plate 9 to be described subsequently is formed at a portion in the longitudinal direction of the switch lever 71 on the rear surface.

Now with particular reference to FIGS. 7 and 9, the coupling between an output shaft 83 of the motor 69 and the inner blade assembly 103 and an operation thereof will be described. An eccentric cam 85 is fixed to the output shaft 83 of the motor 69. The eccentric cam 85 is formed substantially as a cylinder and is fixed at the position at one end slightly off the center of the cylinder to the output shaft 83. An eccentric shaft 87 extends from the other end of the eccentric cam 85. The eccentric shaft 87 performs a reciprocating movement in the arrow B direction in accordance with a rotational movement of the output shaft 83 as a function of the eccentric cam 85.

A vibrator 89 made of synthetic resin such as polypropylene, for example, is fixed to the eccentric shaft 87. The vibrator 89 accordingly makes a reciprocating movement in accordance with the reciprocating movement in the arrow B direction of the eccentric shaft 87. As is particularly clear from FIG. 10, the vibrator 89 is formed integrally of a driver 91 and accordingly the driver 91 also makes a reciprocating movement in the arrow B direction in accordance with rotation of the output shaft 83 of the motor 69. The driver 91 shown in FIG. 9 is shown as partially fragmentary but the same is in actuality formed as integral as shown in FIG. 7. The driver 91 comprises a main body 93, foot portions 95 extending from both ends of the main body 93 and thin portions 97 for coupling the foot portions 95, and supporting portions 99. The supporting portions 99 are fitted into receiving portions formed at appropriate positions of the front half shell body 13 so that the driver 91 is fixedly held. The thin portions 97 serves to absorb vibration of the eccentric shaft 87 and thus vibration in the forward/backward direction or in the arrow C direction in FIG. 8 of the vibrator 89 and to transmit only movement in the arrow B direction in FIG. 9 to the driver main body 93.

A coupling shaft 101 is integrally fixed to the driver main body 93 and the coupling shaft 101 extends upward of the housing through the opening 39 (FIG. 6) formed at the upper end of the housing 1. An inner blade assembly 103 is fixed to the upper end of the coupling shaft 101. The inner blade assembly 103 comprises an arrangement of a number of inner blades in parallel so that the envelope surface of the edges of the inner blades may be in contact with the inner surface of the outer blade 5 and accordingly hairs entered from the outer blade are cut by the outer blade 5 and the inner blades in the course of a reciprocating movement of the driver 91 in the arrow B direction. A cover plate 105 is mounted on the top of the housing 1 to cover the vicinity of the coupling shaft 101. The cover plate 105 serves to prevent the hair dust from entering into the housing 1.

The outer blade frame 3 is detachably mounted onto the top of the housing 1. More specifically, the outer blade frame 3 is held on the housing 1 through engagement of two lock pins 183 and 187 protruding outward from the housing 1 into the recesses 107 and 109 formed on the inner surface of the side wall. Meanwhile, the lock pins 183 and 187 will be described in more detail subsequently. The outer blade 5 is fixed onto the outer blade frame 3 with the same in a bent state. Accordingly, as the inner blade assembly 103 slides reciprocatingly on the inner surface of the outer blade 5, hairs as seized by the hair introducing apertures of the outer blade 5 are cut, as described previously. The end edges of the outer blade frame 3 are folded inward along the side edges of the outer blade 5, whereby grooves 111 are formed. The grooves 111 serve to catch the hair dust scattering outward along the inner surface of the side wall of the outer blade frame 3 through between the upper end of the housing 1 and the outer blade frame 3, thereby to prevent the hair dust from leaking outside to fall on the clothes and on the face skin. Furthermore, the end edges of the side wall of the outer blade frame 3 are formed in a concave curved surface, as shown in FIG. 9. More specifically, the concave curved surface 113 is formed to be inclined so that the same may be aligned with the side end edge of the outer blade 5 through a gap G, thereby to improve a smooth contact feeling of the outer blade at the side end of the outer blade 5 with the skin.

Figure 17:
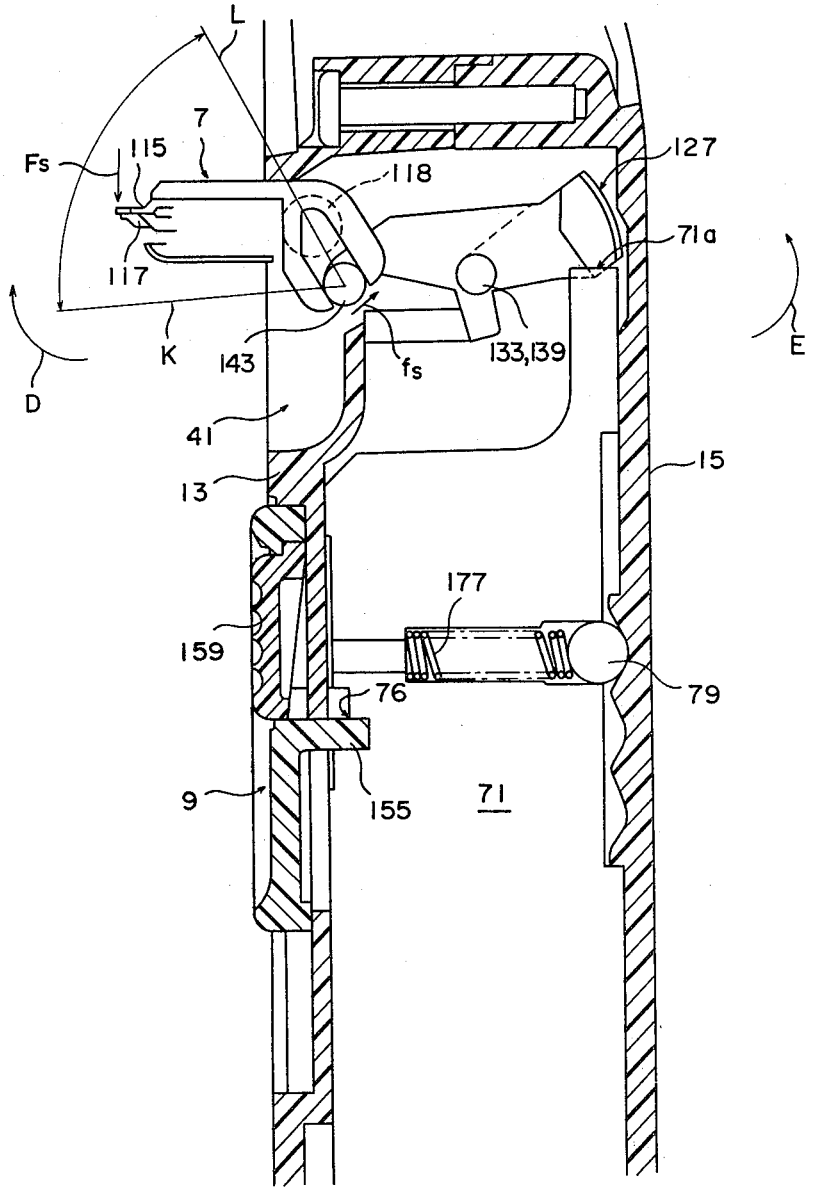
FIG. 17 is a sectional view showing a relation between a trimmer blade assembly, a trimmer lever and a switch plate.

The trimmer blade assembly 7 is received in the recess 41 formed on the outer surface of the front half shell body 13 such that the blade edges of the fixed blade 115 and the movable blade 117 may be directed downward. The fixed blade 115 and the movable blade 117 are comb shaped. The trimmer blade assembly 7 is provided at both ends thereof with a protruding rotational shaft 118 (FIG. 17) and the rotational shaft 118 is fitted into holes 119 (FIG. 6) formed on the wall surfaces of the recess 41. When the trimmer blade assembly 7 is to be used, the same is turned about the rotational shaft 118 in the arrow D direction shown in FIGS. 8 and 7 so that the same is brought to be provided outward of the housing 1. With the trimmer blade assembly 7 protruded outward, the blade edges of the fixed blade 115 and the movable blade 117 are maintained in a position approximately normal to the housing, as shown in FIG. 17. The movable blade 117 of the trimmer blade assembly 7 is coupled to a movable piece 121, as shown in FIG. 8, and a protrusion 123 is formed on the rear end of the moving piece 121. With the trimmer blade assembly 7 protruded, the protrusion 123 is engaged with a claw 125 of the driver 91 protruding from the aperture 45. Accordingly, in such a state the inner blade assembly 103 and the movable blade 117 are reciprocatingly driven. When the trimmer blade assembly 7 is housed in the recess 41, engagement of the protrusion 123 with the claw 125 is released. Such turning of the trimmer blade assembly 7 in the arrow D direction (FIG. 8) is performed by means of the trimmer lever 127.

Figure 14:
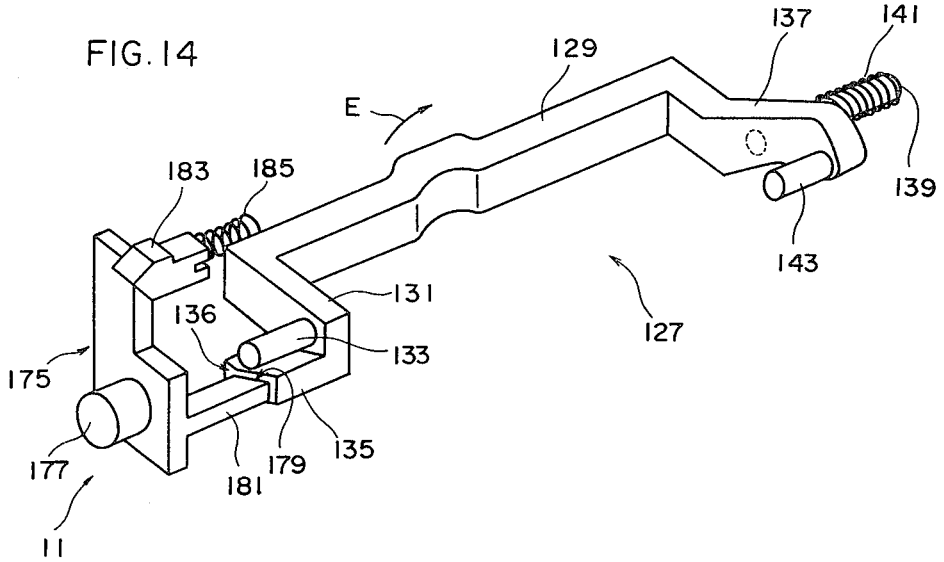
FIG. 14 is a perspective view showing a relation between a trimmer lever and a cleaning operation portion.

The trimmer lever 127 is formed as shown in FIG. 14. The trimmer lever 127 comprises a body piece 129 and foot pieces 131 and 137 extending in parallel from both ends of the body piece 129. Rotational shafts 133 and 139 are provided for the foot pieces 131 and 137, respectively. The rotational shafts 133 and 139 are rotatably mounted in bearings 145 and 147, respectively, formed in the front half shell body 13, as shown in FIG. 10. The trimmer lever 127 is horizontally supported in the housing 1 body means of the rotational shafts 133 and 139 and the bearings 145 and 147, respectively, in cooperation therewith. An engaging pin 143 extending inward from the tip end of the foot piece 137 is brought through an aperture 149 (FIG. 6) formed in the recess 41 of the half shell body 13 to be fitted in an engaging groove 151 (FIG. 10) formed in the rear end portion of the trimmer blade assembly 7. When the body piece 129 of the trimmer lever 127 is rotated in the arrow E direction shown in FIG. 17 through cooperation of the engaging pin 143 and the engaging groove 151, the trimmer blade assembly 7 is brought to be protruded outward of the housing 1.

The rotational shaft 139 of the trimmer lever 127 is inserted into the coil spring 141. When the force exserted upon the body piece 129 in the arrow E direction (FIG. 17) is released, the coil spring 141 returns the trimmer lever 127 and thus the trimmer blade assembly 7 to the home position as a function of a torsional force of the spring 141.

Figure 15:
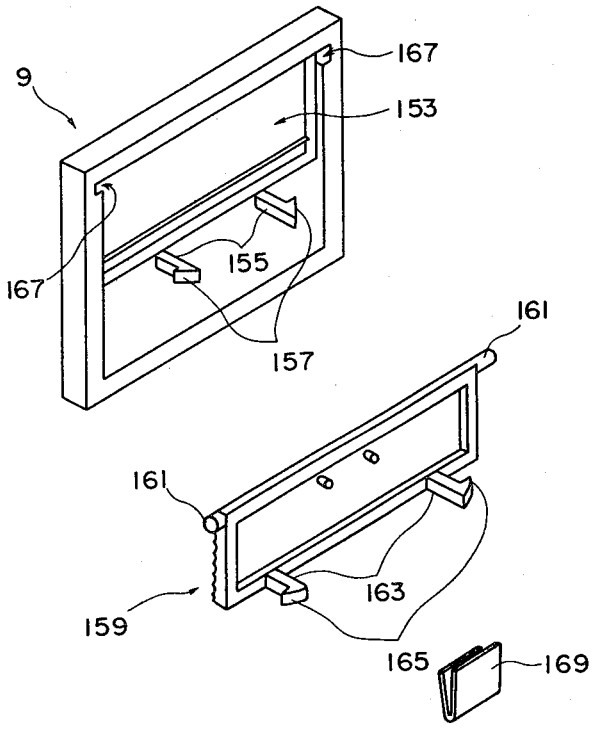
FIG. 15 is a perspective view of a disassembled state of a switch plate and portions associated therewith.

The switch plate 9 is received in the recess 43 (FIG. 6) formed in the front half shell body 13 to be slidable in the arrow A direction (FIG. 1). The switch plate 9 has an opening 153 and a pair of foot pieces 155 extending in parallel with each other from the rear surface thereof as shown in FIG. 15. Protrusions 157 are formed at the tip ends of the pair of foot pieces 155, respectively. The foot pieces 155 of the switch plate 6 are brought to be inserted into the housing 1 through the pair of slits 47 formed in the recess 43 of the front half shell body 13. The protrusions of the foot pieces 155 are engaged with the periphery of the slit 47 after the foot pieces 155 are inserted through the slit 47, so that the switch plate 9 is held by the half shell body 13 to be slidable. As shown in FIGS. 8 and 17, the switch plate 9 and the switch lever 71 are slidable in an associated manner through fitting of the tip ends of the foot pieces 155 of the switch plate into the concave 78 (FIG. 13) formed on the side surface of the switch lever 71.

When the switch plate is raised to the third position, associatedly the tip end 71*a* of the switch lever 71 raises the body piece 129 of the trimmer lever. As a result, the trimmer blade assembly 7 is protruded outward of the housing 1 (FIG. 17).

A lock button 159 is built in the switch plate 9 and, according to the embodiment shown, sliding of the switch plate 9 without depression of the lock button 159 is prevented. The lock button 159 is implemented in a plate shape, as shown in FIG. 15, and rotational shafts 161 are provided at both upper ends. A pair of foot pieces 163 extending in parallel with each other are formed on the rear surface at the lower end of the lock button 159. Protrusions 165 are formed at the respective tip ends of the pair of foot pieces 163. The lock button 159 is positioned in the opening of the switch plate 9 through fitting of the rotational shafts 161 into the bearings 167 of the switch plate 9.

Figure 16:
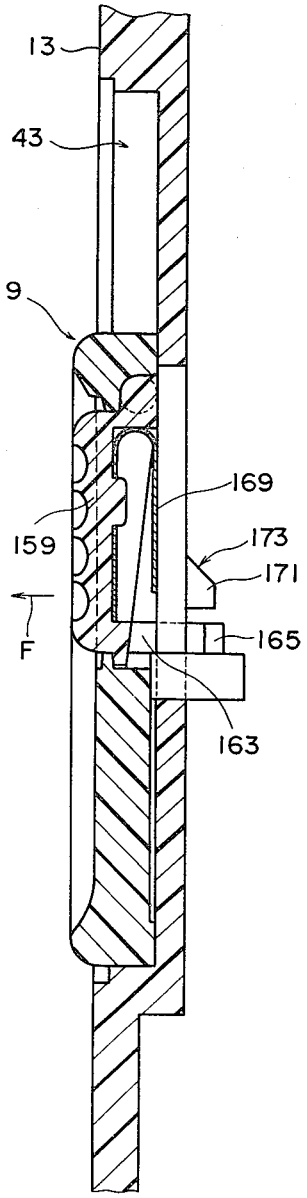
FIG. 16 is a sectional view mainly showing a lock button and portions associated therewith.

The pair of foot pieces 163 of the lock button 159 are fitted into a pair of guide grooves 49 formed in the recess 43 of the front half shell body 13 such that the lock button 159 and thus the switch plate 9 may be slidable in the arrow A direction (FIG. 1). A leaf spring 169 bent in a U letter shape, as shown in FIG. 16, is inserted between the lock button 159 and the front half shell body 13. Accordingly, the lock button 159 is normally biased or urged in the arrow F direction (FIG. 16) by means of the leaf spring 169.

The protrusions at the tip ends of the foot pieces 163 of the lock button 159 are engaged with the periphery of the guide grooves 49, thereby to secure the lock button 159 to the half shell body 13. A trapezoidal protrusion 171 (FIG. 16) is formed on the surface of the half shell body 13 at the periphery of the guide groove 49. The protrusion 171 is positioned such that the foot pieces 163 of the lock button 159 are brought beneath the protrusion 171 at the first position of the switch plate 9.

Figure 18:
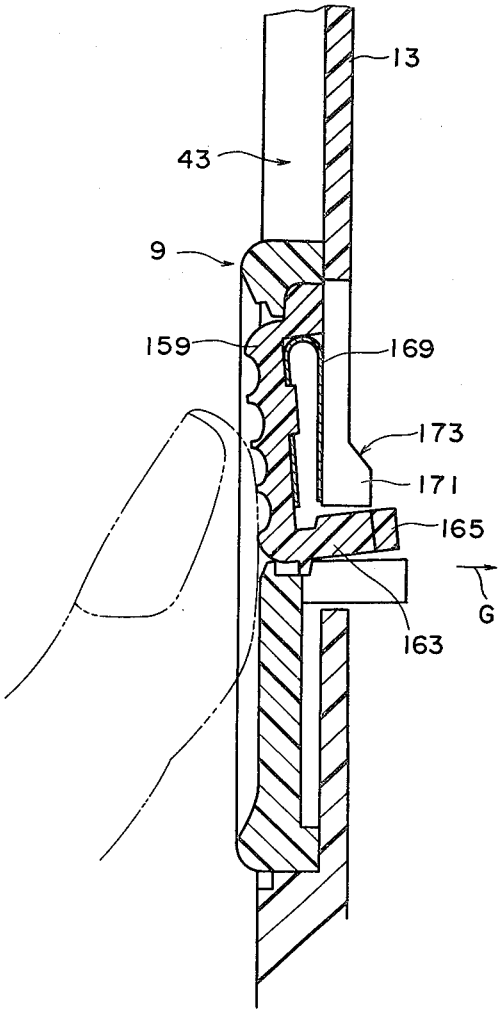
FIG. 18 is a sectional view for depicting an operation of a lock button.

In the case where the switch plate 9 is slid upward from the home position or the first position to the second position or the third position, the lock button 159 is manually in the arrow G direction by a finger, as shown in FIG. 18. By doing so, the protrusion 165 formed at the tip end of the foot piece 163 is displaced rearward (in the arrow G direction) of the trapezoidal protrusion 171. The switch plate 5 is moved upward together with the lock button 159 wile the protrusion 165 is brought so as not to be in contact with the trapezoidal protrusion 171.

On the contrary, in the case where the switch plate 9 is lowered, i.e. in the case where the switch plate 9 is returned to the home position, the protrusion 165 of the foot piece 163 is guided along the oblique surface 173 of the trapezoidal protrusion 171 and therefore the protrusion 165 readily moves over the trapezoidal protrusion 171 in accordance with the downward movement of the switch plate 9. Accordingly, it is not necessary to depress the lock button 159 in such a case.

The cleaning operation portion 11 constitutes one feature of the embodiment shown and is aimed to enable the trimmer blade assembly 7 to be protruded outward even in the case where the switch plate 9 is not in the third position. More specifically, operation or depression of the cleaning operation portion 11 causes the trimmer lever 127 to be rotated in the arrow E direction (FIG. 17), thereby to protrude the trimmer blade assembly 7, with the movable blade 117 brought in a rest or intact state, so that the trimmer blade assembly 7 can be cleaned.

The cleaning operation portion 11 has a base plate 175 and an operation button 177 protruding from the base plate 175. The operation button 177 is protruded outward of the side surface of the housing 1 through the aperture 33 formed in the U letter shaped outer frame 17 and the apertures formed with the half shell bodies 13 and 15 at the positions corresponding thereto, as shown in FIG. 11. The operation button 177 is slidable in the arrow H direction (FIG. 11). The protrusion 181 having the oblique surface 179 at the tip end formed on the rear surface of the base plate 175. The oblique surface 179 of the protrusion 181 is in sliding contact with the oblique surface 136 at the tip end of the protrusion 135 protruded outward from the tip end of the foot piece 131 of the trimmer lever 127, as shown in FIGS. 11 and 14.

In the case where the operation button 177 is depressed in the housing 1, the trimmer lever 127 is rotated in the arrow E direction (FIG. 17) as a function of the two oblique surfaces 136 and 179. When the trimmer lever 127 is thus rotated, the trimmer blade assembly 7 can be protruded outward of the housing 1 in the same manner as described previously in conjunction with the switch lever 71. Since the switch plate 9 and thus the switch lever 71 is in the first position, i.e. the home position at that time, no electric power is supplied from the rechargeable batteries 65 to the motor 69. Accordingly, by depressing or operating the operation button 177, the trimmer blade assembly 7 can be protruded outward of the housing 1 with the movable blade 117 in a rest or intact state. Therefore, in cleaning the trimmer blade assembly 7 with a brush, the bristles, hair or the like of the brush are not damaged.

If and when depression of the operation button 177 is released, the trimmer lever 127 is returned to the original state, i.e. the position for retracting the trimmer blade assembly 7, as a function of the previously described coil spring 141.

Figure 19:
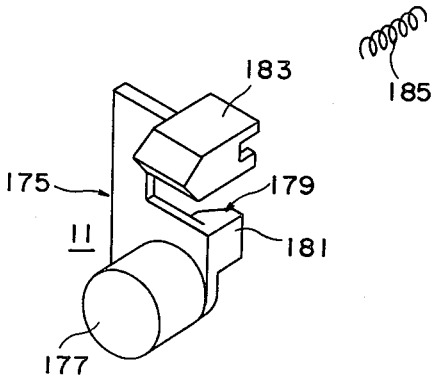
FIG. 19 is a perspective view showing a cleaning operation portion and one lock pin.
Figure 20:
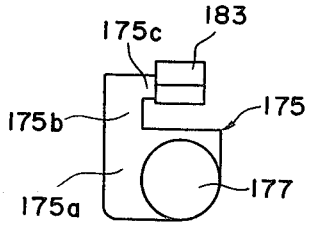
FIG. 20 is a left side view of FIG. 19.
Figure 21:
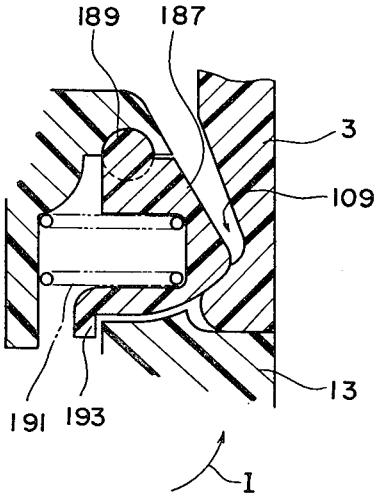
FIGS. 21 and 22 are sectional views showing a structure and operation of the other lock pin.

The lock pin 183 is formed integrally of the base plate 175 of the cleaning operation portion 11, as shown in FIGS. 14 and 19. The lock pin 183 raises the outer blade frame 3 from the housing 1, as shown in FIG. 5, on the occasion of depression of the operation button 177, thereby to make it possible to remove the outer blade frame 3 with ease. More specifically, the embodiment is structured such that when the operation button 177 included in the cleaning operation portion 11 is depressed not only the trimmer blade assembly 7 but also the inner blade assembly 103 and the outer blade 5 can be simultaneously cleaned. The lock pin 183 is shaped as an arrow at the tip end thereof, as shown in FIGS. 9, 14 and 19. As is particularly seen from FIG. 20, the base plate 175 comprises a wide portion 175*a*, a narrow portion 175*b*, and a coupling portion 175*c* formed at the tip end of the narrow portion 175*b*. The narrow portion 175*b* and the coupling portion 175*c* integrally couples the operation button 177 and the lock pin 183. Meanwhile, the cleaning operation portion 11 and the lock pin 183 are integrally formed with a material of elasticity such as synthetic resin for example. The embodiment is adapted such that a displacing force exerted to the operation button 177 is directly transmitted to the lock pin 183 as a function of the narrow portion 175*b* and the coupling portion 175*c*; however, a displacing force being exerted on the lock pin 183 is not transmitted to the operation button 177 and thus to the trimmer lever 127 as a force for displacing them. Accordingly, in fixing the outer blade frame 3 to the housing 1, even if the lock pin 183 is depressed inward by means of the lower edge of the outer blade frame 3, the protrusion 179 (FIG. 11) is not depressed by the protrusion 181, whereby the trimmer blade assembly 7 is prevented from being protruded. More specifically, due to elasticity of the material being utilized, only the coupling portion 175*c* and the narrow portion 175*b* are deformed in the case where the lock pin 183 is depressed into the housing 1, while displacement of the lock pin is not transmitted very much to the wide portion 175*a*. On the other hand, a displacement force acting upon the wide portion 175*a* is transmitted directly to the lock pin 183.

The lock pin 183 is urged outward of the housing 1 by means of the coil spring 185. Accordingly, the lock pin 183 can normally be protruded outward independently of the operation button 177.

Figure 22:
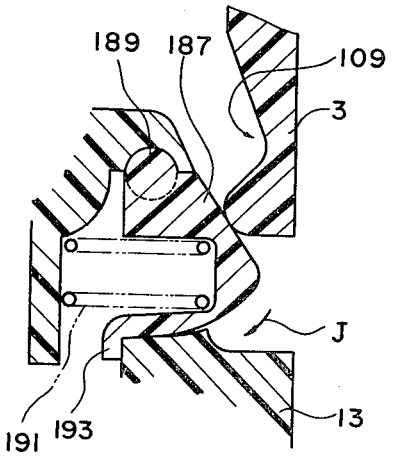

Now another lock pin 187 will be described. As seen from FIGS. 9, 21 and 22, the tip end thereof is shaped generally triangular and is rotatably supported at the side end of the upper end portion 35 of the front half shell body 13 by means of the shaft 189. A spring 191 is provided in association with the lock pin 187 and the lock pin 187 is urged in the arrow I direction (FIG. 21) by means of the spring 191. The stopper 193 is formed at the lower end of the lock pin 187 so that the stopper 193 is engaged with an appropriate position of the half shell body 13, whereby the lock pin 187 is prevented from coming out through a spring force of the spring 191. The lock pin 187 is rotatable from the position shown in FIG. 21 in the arrow J direction shown in FIG. 22. In the case where the outer blade frame 3 is fixed, it follows that the upper surface of the lock pin 187 is depressed with the lower end of the outer blade frame 3, as shown in FIG. 22, and accordingly the lock pin 187 is rotated about the shaft 189 in the arrow J direction. When the lock pin 187 is fitted into the concave 109 of the outer blade frame 3, thereafter the lock pin 187 is urged by the spring 191 in the arrow I direction (FIG. 21) and therefore the outer blade frame 3 is held by the lock pin 187 and the concave 109. In the case where the outer blade frame 3 is to be removed, the outer blade frame 3 cannot be removed from the housing 1 unless the operation button 177 included in the cleaning operation portion 11 is operated. The reason will be described in the following. More specifically, in the case where the outer blade frame 3 is to be removed, the outer blade frame 3 is raised upward at the side of the lock pin 187, when the lock pin 187 is about to be rotated in the arrow I direction (FIG. 21) due to fitting of the outer blade frame 3 to the concave 109. However, in such a case the lock pin 187 is prevented from being further rotated as a function of the stopper 193 provided to the lock pin 187. Accordingly, the outer blade frame 3 cannot be removed from the lock pin 187. In removing the outer blade frame 3, the lock pin 183 at the side of the cleaning operation portion 11 is depressed in the arrow H direction (FIG. 11) by means of the operation button 177 as described previously, whereby the outer blade frame 3 is removed from the side of the lock pin 183. Then the outer blade frame 3 is also removed at the side of the lock pin 187. In thus removing the outer blade frame 3, since the same cannot be removed unless the cleaning operation portion 11 and thus the operation button 177 is operated, a problem does not arise wherein the outer blade frame 3 is erroneously detached from the housing 1 otherwise than required.

The above described embodiment involves a problem to be set forth in the following description in conjunction with the trimmer blade assembly 7. More specifically, as shown in FIG. 17, a straight line K connecting the rotational shafts 131 and 139 for rotatably supporting the trimmer lever 127 with respect to the housing and the engaging pin 143 provided to the trimmer lever 127 and a straight line L extending along the rotational shaft 118 for rotatably supporting the trimmer blade assembly 7 to the housing do not intersect at a right angle. Therefore, when the force Fs shown in FIG. 17 is exerted at the tip end of the trimmer blade assembly 7, a force fs in the tangential direction of the outer periphery of the rotational shaft 118 is exerted upon the engaging pin 143. Therefore, a moment is caused about the rotational shafts 131 and 139 and as a result the trimmer lever 127 is rotated in the direction opposite to the arrow E (FIG. 17), with the result that the trimmer blade assembly 7 is returned to the side of the recess 41. In the case where the electric shaver is used with the trimmer blade assembly 7 protruded outward, the force Fs is exerted in most cases and in such a situation the trimmer blade assembly 7 is retracted to the recess 41 with the resultant problem that shaving cannot be performed using the trimmer blade assembly 7.

Figure 23:
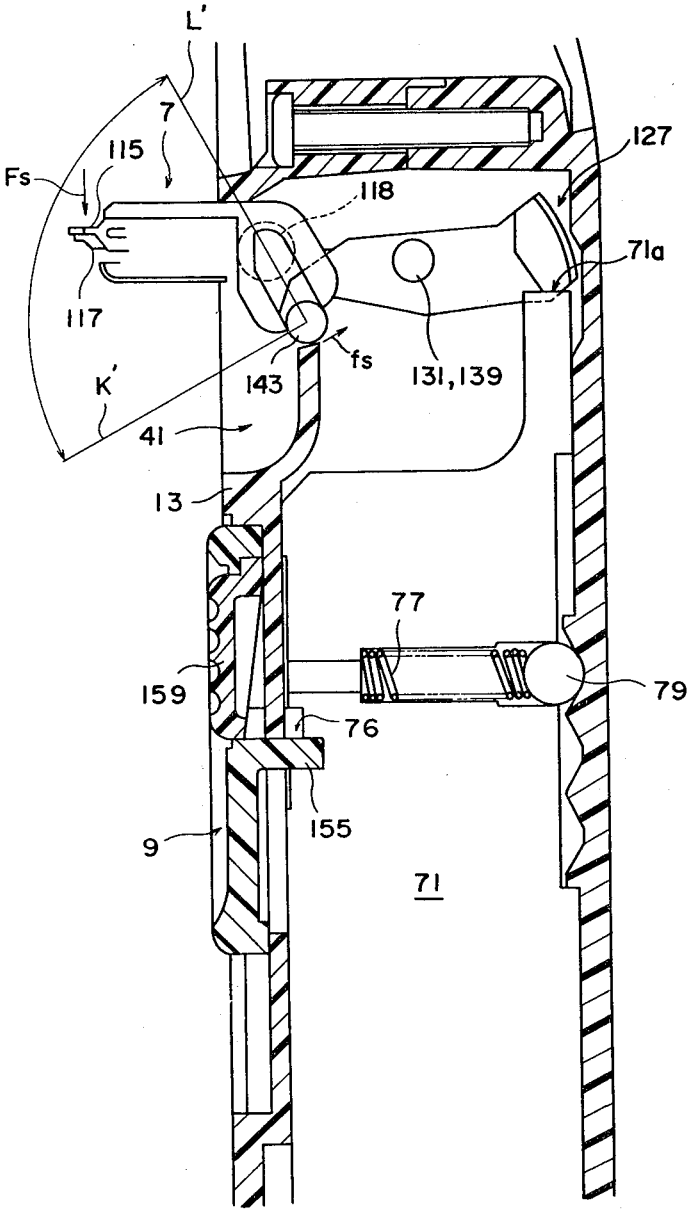
FIG. 23 is a sectional view showing a major portion of another embodiment of the present invention and corresponds to FIG. 17.

In consideration of the foregoing, another embodiment of the present invention employs a structure as shown in FIG. 23. More specifically, the trimmer lever 127 is rotatably supported in the housing by means of the rotational shafts 131 and 139. The trimmer blade assembly 7 is rotatably supported in the housing by means of the rotational shaft 118 positioned on the axis in parallel with the rotational shafts 131 and 139. The engaging pin 143 of the trimmer lever 127 is engaged with the engaging groove formed at the rear end of the trimmer blade assembly 7. The trimmer blade assembly 7 is rotated about the rotational shaft 118 as the trimmer lever 127 is rotated. As is clear from a comparison with the FIG. 17 embodiment, the FIG. 23 embodiment is adapted such that a straight line K′ connecting the engaging pin 143 and the rotational shafts 131 and 139 and a straight line L′ connecting the rotational shaft 118 and the engaging pin 143 are disposed to intersect at approximately a right angle. Therefore, even if the force Fs as shown in FIG. 23 is applied to the trimmer blade assembly 7 so that the force fs in the tangential direction of the outer periphery of the rotational shaft 118 is exerted upon the engaging pin 143, no moment about the rotational shafts 131 and 139 is caused. The reason is that the direction of the force fs is consistent with the direction of the straight line K' connecting the engaging pin 143 and the rotational shafts 131 and 139. Accordingly, the trimmer blade assembly 7 is not retracted in the recess 41 even by the force Fs exerted upon the tip end thereof. Accordingly, it does not often occur that the trimmer blade assembly 7 is undesirably retracted while the same is being used.

Figure 24:
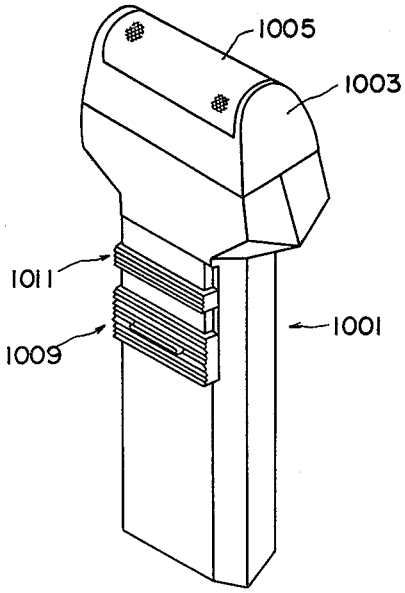
FIG. 24 is a perspective view showing an appearance of the other embodiment of the present invention.
Figure 25:
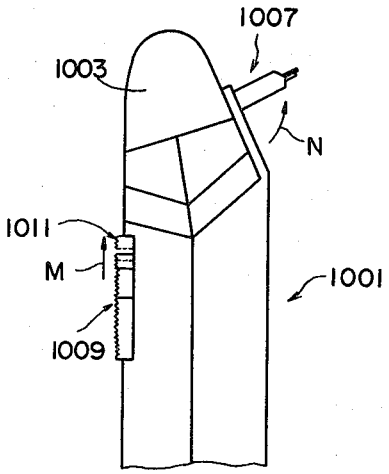
FIG. 25 is a right side view of FIG. 24, omitted in part.

FIG. 24 is a perspective view showing an appearance of an electric shaver of a reciprocating drive type having a trimmer blade in accordance with a further embodiment of the present invention. FIG. 25 is a right side view, partially omitted, of the FIG. 24 embodiment. Now referring to FIGS. 24 and 25, an outline of the embodiment will be described.

The electric shaver comprises a housing 1001. An outer blade frame 1003 is mounted to the top portion of the housing 1001 and an outer blade 1005 is held in the outer blade frame 1003. As in the case of the previously described embodiment, an inner blade assembly is provided in the outer blade 1005 so as to be in contact with the inner surface of the outer blade 1005. A trimmer blade assembly 1007 is provided on the rear surface of the housing 1001 such that the blade edge may be protrusile in the arrow N direction (FIG. 25). A switch plate 1009 and a trimmer operation plate 1011 are provided on the front surface of the housing 1001. The switch plate 1009 is structured to be slidable in the arrow M direction (FIG. 25) so that the same may selectively assume three stop positions, as is in the case of the previously described embodiment. The trimmer operation plate 1011 is also structured to be similarly slidable in the arrow M direction so that the same may selectively assume two stop positions. The trimmer operation plate 1011 corresponds to the cleaning operation portion 11 of the previously described embodiment. A trimmer lever (FIGS. 26 and 27) is coupled to the trimmer blade assembly 1007, as in the case of the previously described embodiment, so that the trimmer blade assembly 1007 may be switched to the position thereof as retracted toward the housing 1001 or the position thereof protruded outward by means of the trimmer lever.

At the first position of the switch plate 1001 (in the state as shown in FIG. 25), a power supply to the motor is interrupted. Accordingly, neither the inner blade assembly nor the trimmer blade assembly 1007 is driven. Then at the second position of the switch plate 1009 (not shown), a power supply to the motor is turned on and only the inner blade assembly (not shown) is driven, whereby a shaving operation by means of the inner blade assembly and the outer blade 1005 is enabled. At the third position of the switch plate 1009 (in a state shown by the dotted line in FIG. 25), the trimmer blade assembly 1007 can be maintained in a state of being protruded outward of the housing 1001 in the arrow N direction while the inner blade assembly is driven, as shown in FIG. 25. At that time the trimmer blade assembly 1007 is driven in association with the inner blade assembly.

The trimmer operation plate 1011 acts upon a trimmer lever (to be described subsequently) for driving the trimmer blade assembly 1007. Accordingly, as shown by the dotted line in FIG. 25, in the state where the trimmer operation plate 1011 is slid in the arrow M direction, the trimmer lever is driven so that the trimmer blade assembly 1007 can be protruded outward even at the first position of the switch plate 1009. More specifically, the trimmer blade assembly 1007 is protruded in the arrow N direction (FIG. 25) even in a state where the trimmer blade assembly 1007 is not driven through operation of the trimmer operation plate 1011, whereby the trimmer blade assembly 1007 can be cleaned without damaging the bristles of the brush, for example.

The housing 1001 comprises a narrow portion 1002 and a wide portion 1004 disposed in the length direction, wherein the narrow portion 1002 is allotted for holding by a hand. The outer blade frame 1003 is detachably provided to the wide portion 1004.

Figure 34:
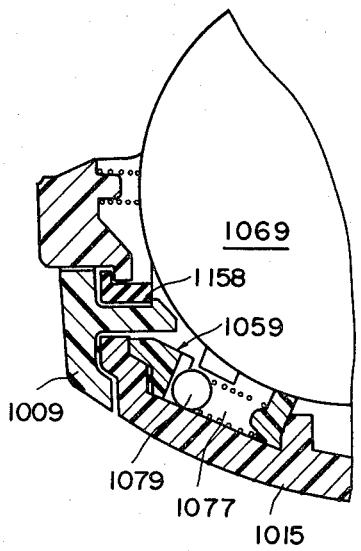
FIG. 34 is a sectional view mainly showing a structure of a switch plate and portions associated therewith.
Figure 35:
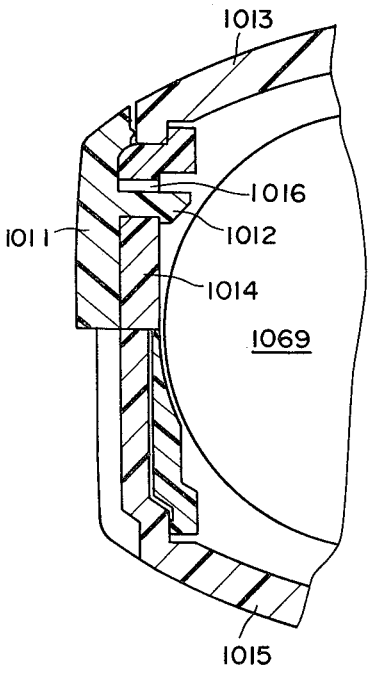
FIG. 35 is a sectional view mainly showing a structure of a trimmer operation plate and portions associated therewith.

Now referring to FIGS. 26 to 35, the structure and the features of the electric shaver of the embodiment shown will be described. In the following, first the whole structure thereof will be described mainly with respect to FIGS. 26, 27, 28 and 29, then the trimmer lever 1127 and an operation in conjunction therewith will be described mainly with reference to FIG. 30, and thereafter the switch plate 1009 and an operation in conjunction therewith will be described mainly with respect to FIGS. 31 to 33. FIG. 34 is a sectional view showing in part a fixed state of the switch plate 1009 and FIG. 35 is a sectional view showing in part a fixed state of the trimmer operation plate 1011.

The housing 1001 (FIG. 24) comprises two half shell bodies 1013 and 1015. The respective half shell bodies 1013 and 1015 are each made of synthetic resin, for example, wherein both are integrally united to constitute the housing 1001. A recess 1043 is formed at a portion on the front surface of the half shell body 1013. The recess 1043 is allotted as a portion for slidably holding the switch plate 1009 in the arrow M direction (FIG. 25). A pair of slits 1047 are formed in the recess 1043. The slits 1047 are aimed at insertion therethrough of engaging claws 1157 protrudingly formed on the rear surface of the switch plate 1009. A window 1041 is formed at the top of the recess 1043. The window 1041 is aimed at insertion therethrough of the engaging claw 1012 protrudingly formed on the rear surface of the trimmer operation plate 1011. Notches are formed at the upper ends 1035 and 1037 of the half shell bodies 1013 and 1015 for constituting an opening 1039 through coordination therewith. A coupling shaft 1101 for imparting a drive force to the inner blade assembly (FIG. 29) can be protruded upward of the housing 1001 through the opening 1039, as to be described subsequently.

Apertures 1038 for the trimmer blade assembly 1007 are formed in the wide portion of the rear half shell body 1015. The trimmer blade assembly 1007 comprises a movable member 1120, which is formed with a coupling protrusion 1122 at approximately the center thereof in the length direction. A pair of arms 1118 are formed at both ends of the trimmer blade assembly 1007 in the width direction. The arms 1118 are inserted into the housing through the above described apertures 1038, whereby the trimmer blade assembly 1007 may be driven by means of the motor 1069. A switch base plate 1158, a trimmer lever operating plate 1014, a trimmer lever 1127, a motor 1069 and a driver assembly 1088 are housed in a housing constituted with two half shell bodies 1013 and 1015.

The switch base plate 1158 is made of an insulating material and is formed with engaging apertures 1160. A movable contact 1162 made of a conductive material for the supply of electric power (not shown) to a motor 1069 is formed at a lower portion of the switch base plate 1158. The switch base plate 1158 is integrally coupled to the switch plate 1009. More specifically, an engaging claw 1157 of the switch plate 1009 is inserted through a slit 1047 formed in the recess 1043 of the half shell body 1013. The engaging claw 1157 is further inserted through an engaging aperture 1160 of the switch base plate 1158. The engaging claw 1157 is engaged with the periphery of the engaging aperture 1160, whereby the switch plate 1009 and the switch base plate 1158 are integrally united, as shown in FIG. 34.

The trimmer lever operating plate 1014 is integrally coupled to the trimmer operation plate 1011. More specifically, a pair of engaging claws 1012 of the trimmer operation plate 1011 are inserted through the window 1041 formed in the half shell body 1013. Then the engaging claws 1012 are engaged with the engaging apertures 1016 formed in the trimmer lever operation plate 1014. More specifically, the engaging claws 1012 are engaged with the periphery of the engaging apertures 1016, whereby the trimmer operation plate 1031 and the trimmer lever operation plate 1014 are integrally united, as shown in FIG. 35.

A serration 1059 is formed at the side end portion on the rear surface of the switch base plate 1158. The serration 1059 cooperates with a ball 1079 to perform a function of assuredly stopping at any one of the three stop positions the switch base plate 1158 and thus the switch plate 1009. More specifically, a spring 1077 is held by means of a spring holding member 1076 at a predetermined position in the housing. The ball 1079 is received by the end of the spring 1077 so that the ball 1079 is urged toward the serration 1059. Accordingly, the ball 1079 is fitted into a concave formed in the serration 1059, whereby the switch base plate 1158 is selectively stopped at that position. In other words, a click stop function is achieved by the switch plate 1009 in association with the ball 1079.

The trimmer lever 1127 cooperates with the trimmer lever operating plate 1014 to selectively bring the trimmer blade assembly 1007 in any one of the two positions or states, i.e. a state of the trimmer blade assembly 1007 protruded outward of the housing or a state of the trimmer blade assembly 1007 retracted toward the housing. The trimmer lever 1127 comprises a body piece 1129 and foot pieces 1131 extending from both ends of the body piece 1129 in parallel with each other. The pair of foot pieces 1131 are each formed with pivoting pins 1133 and coupling pins 1143 at the side surfaces thereof. The pair of pivoting pins 1133 are pivoted by a pair of bearings 1145 formed on the inner surface of the wide portion of the front half shell body 1013, so that the trimmer lever 1127 is supported to be rotatable about the pair of pins 1133. The pair of coupling pins 1143 are fitted to a pair of arms 1118 formed at both ends of the trimmer blade assembly 1007 in the housing. Accordingly, as the trimmer lever 1127 is rotated about the pins 1133, the trimmer blade assembly 1007 is accordingly rotated about the coupling pins 1143. One of the pivoting pins 1133 of the trimmer lever 1127 is inserted with a coil spring 1141, so that the trimmer lever 1127 is normally returned to the home position by means of the spring 1141. Accordingly, in a state where the trimmer operating plate 1014 does not act upon the trimmer lever 1127, the trimmer blade assembly 1007 is placed in a state of being retracted toward the housing by means of the spring 1141.

A motor 1069 is housed in the housing and the motor 1069 is supplied with electric power from a power supply (not shown) depending upon the position of the switch base plate 1158 so that the motor 1069 is energized. An eccentric cam 1085 is coupled to the output shaft 1083 (FIG. 29) of the motor 1069. An eccentric shaft 1087 extends from the other end of the eccentric cam 1085. The eccentric shaft 1087 makes a reciprocating movement in accordance with rotation of the output shaft 1083 by means of the eccentric cam 1085, as in the case of the previously described embodiment. A driver assembly 1088 is coupled to the eccentric shaft 1087. More specifically, a vibrator 1089 is fixed to the eccentric shaft 1087. The vibrator 1089 is formed integrally of foot portions 1095 extending from a main body 1093 of the driver 1091, whereby the driver 1091 is also caused to make a reciprocating movement in accordance with rotation of the output shaft 1083 of the motor 1069. The driver 1091 further comprises a thin portion 1097 and a holding portion 1099, while a coupling shaft 1101 is formed on the driver main body 1093. The function of the thin portion 1097 is the same as that of the previously described embodiment. The coupling shaft 1101 extends to above the housing through the opening 1039 (FIG. 26) at the upper end of the housing. An inner blade assembly 1103 (FIG. 28) is fixed to the upper end of the coupling shaft 1101. Accordingly, the inner blade assembly 1103 is caused to make a reciprocating movement in accordance with energization of the motor 1069.

Figure 29:
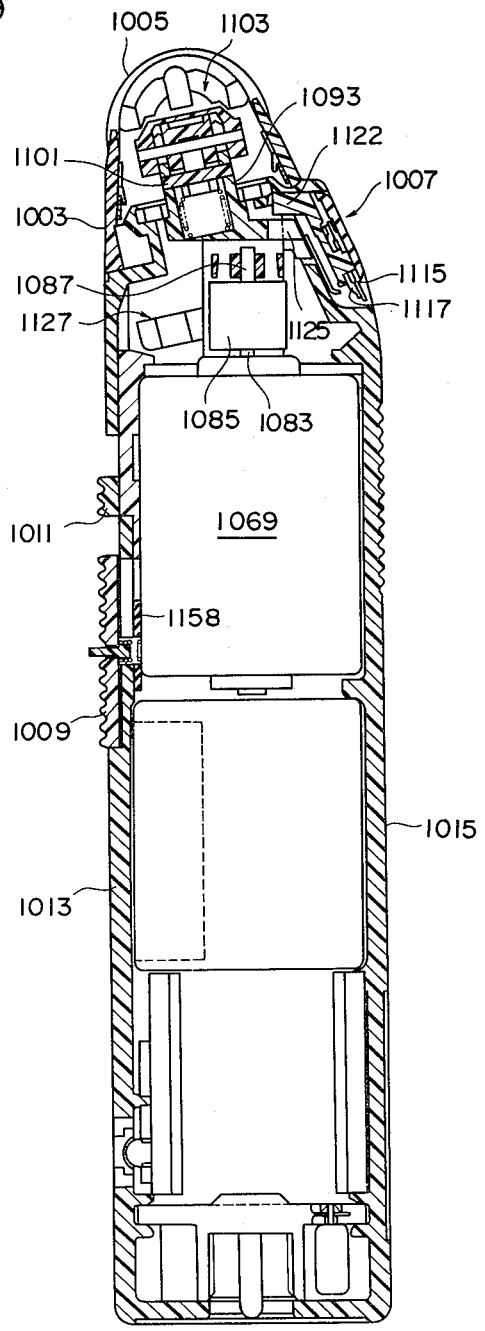
FIG. 29 is a sectional view taken along the line XXIX—XXIX in FIG. 28.

With particular reference to FIG. 29, the trimmer blade assembly 1007 comprises a combination of the fixed blade 1115 and a movable blade 1117 and is formed with a coupling protrusion 1122 at the rear end thereof. The coupling protrusion 1122 is held by a claw 1125 extending from the driver main body 1093. The claw 1125 is engaged with a coupling protrusion 1122 in the state of the trimmer blade assembly 1007 being as shown in FIG. 25. Accordingly, in such a state, the inner blade assembly 1103 and the movable blade 1117 are associatedly driven in a reciprocating manner by means of the motor 1069. In the case where the trimmer blade assembly 1007 is placed in a state of being retracted toward the housing, engagement of the claw 1125 with the coupling protrusion 1122 is released, as seen from FIG. 29. Rotation of the trimmer blade assembly 1007 in the arrow N direction (FIG. 25) is performed through the trimmer lever 1127.

Figure 30:
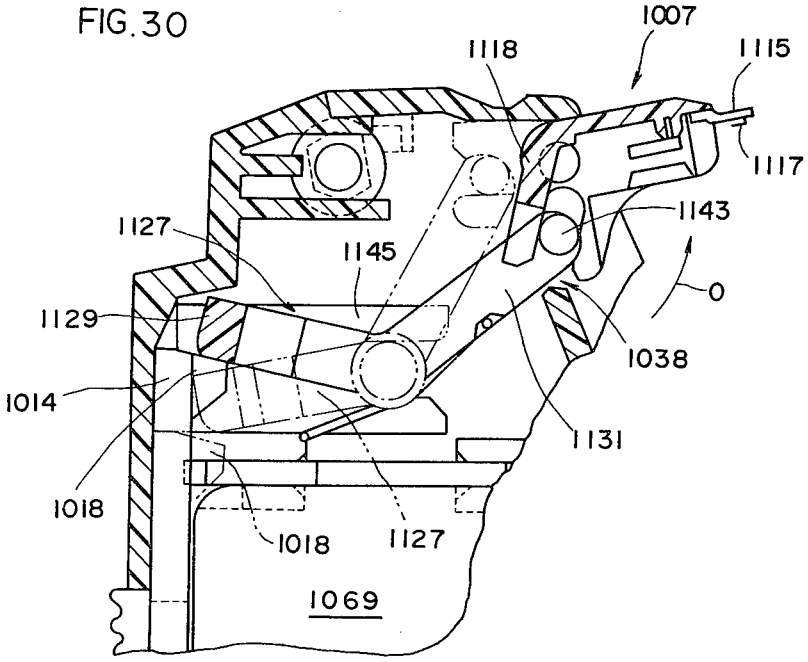
FIG. 30 is a sectional view mainly depicting an operation of a trimmer lever and portions associated therewith of the above described embodiment.
Figure 26:
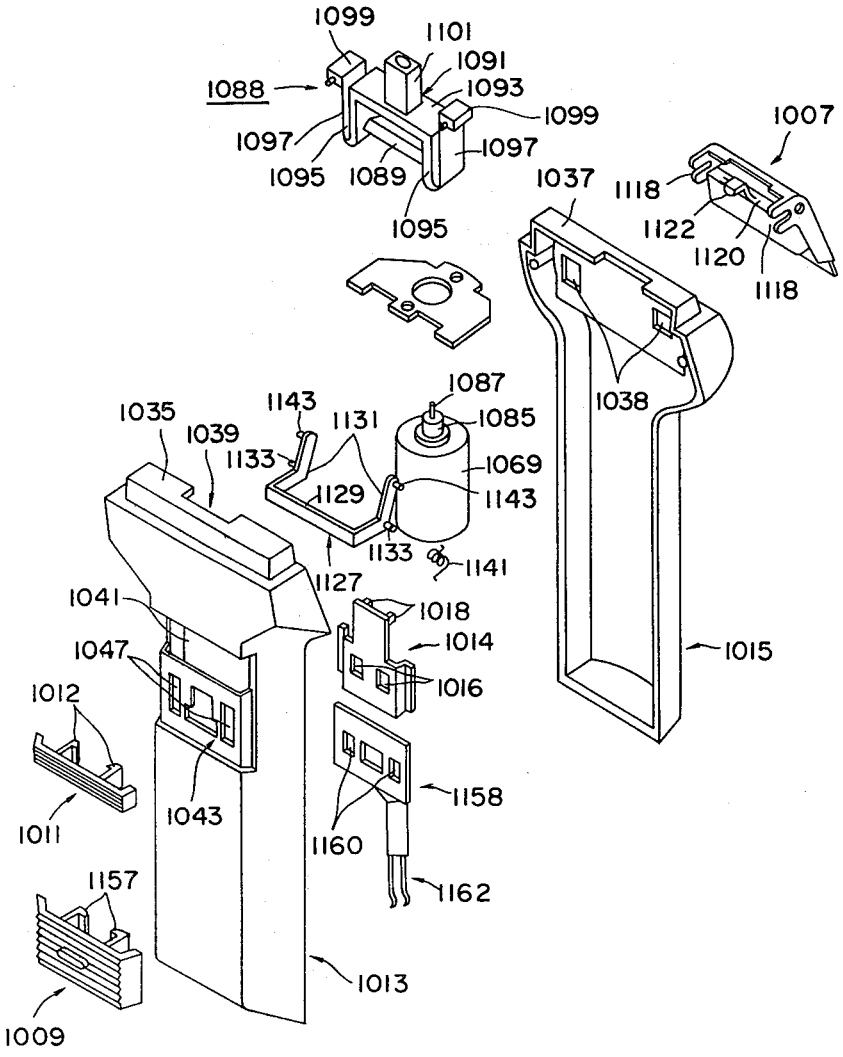
FIGS. 26 and 27 are perspective views of disassembled states showing the respective components constituting the above described embodiment.
Figure 27:
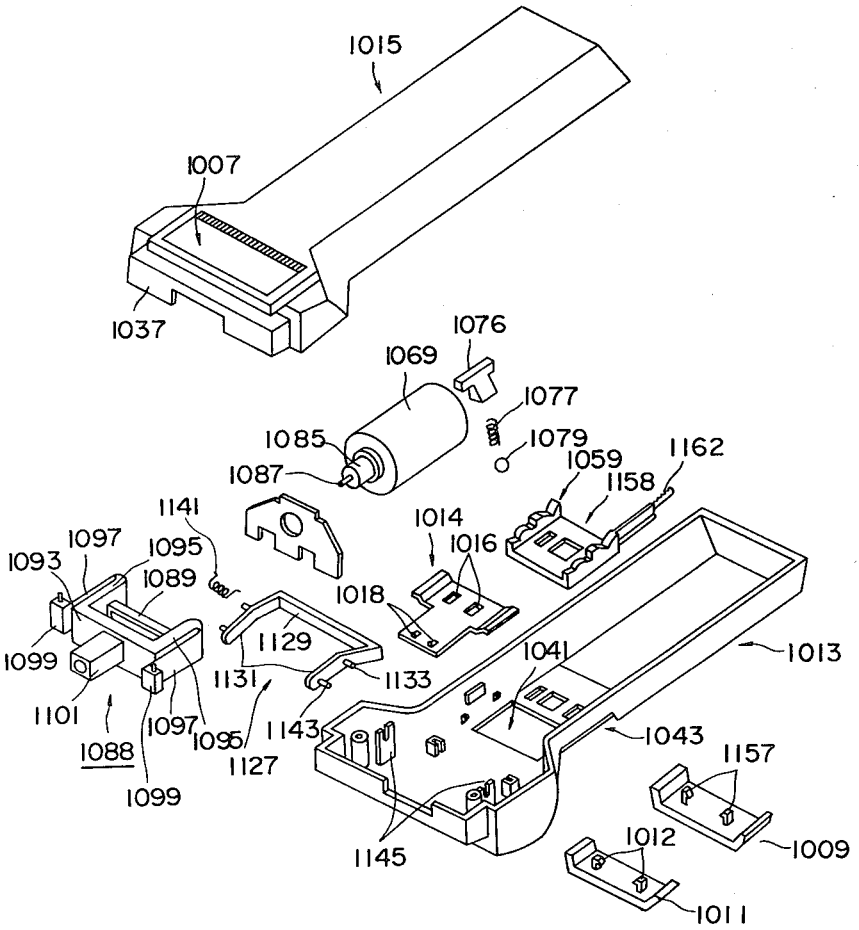
Figure 28:
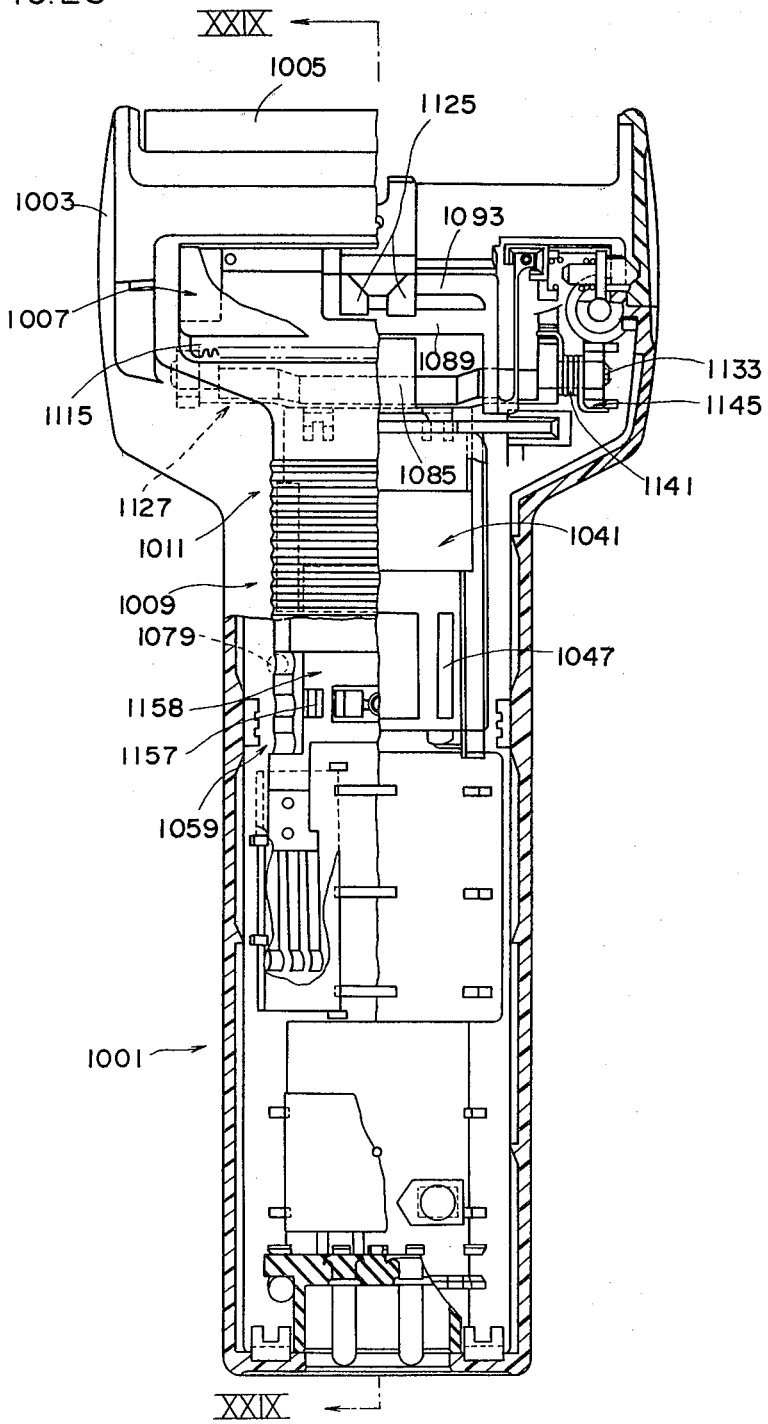
FIG. 28 is a front view, partially fragmentary, showing a structure inside the housing.

A protrusion 1018 is provided at the upper end of the trimmer lever operating plate 1014 coupled in the housing to the trimmer operation plate 1011 outside the housing. When the trimmer lever operating plate 1014 is raised upward, the protrusion 1018 is accordingly placed in contact with the body piece 1129 of the trimmer lever 1127, thereby to raise the same. More specifically, when the trimmer operation plate 1011 is raised upward, as shown in FIG. 30, the protrusion 1018 raises the body piece 1129, thereby to rotate the trimmer lever 1127 about the pivoting pin 1133. Accordingly, the trimmer blade assembly 1007 is rotated in the arrow O direction (FIG. 30), whereby the same is protruded outward from the receiving recess. When the upward directional force acting upon the trimmer lever operation plate 1014 is removed, the trimmer lever 1127 and thus the trimmer blade assembly 1007 is automatically returned to a predetermined position by means of the spring 1141 (FIG. 26).

Figure 31:
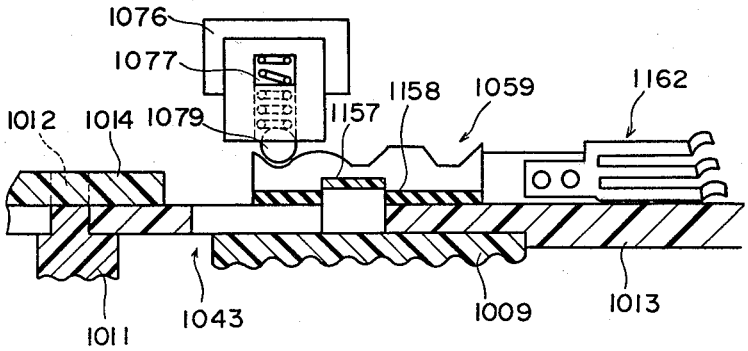
FIGS. 31 to 33 are sectional views mainly showing the respective states of a switch plate, a trimmer operation plate and portions associated therewith of the embodiment described.

In a state as shown in FIG. 31, i.e. on the occasion of the home position or the first position of the switch plate 1009, the motor is not supplyed with an electric power from the movable contact 1162 and accordingly the same as well as the trimmer blade assembly 1007 of the inner blade assembly 1103 (FIG. 29) is not driven.

Figure 32:
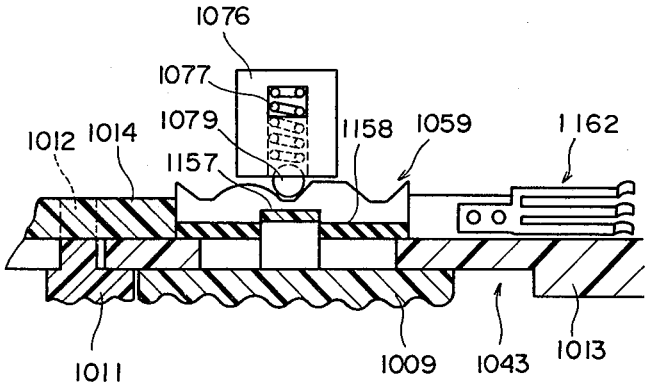

FIG. 32 shows a state where the switch plate 1009 is placed in the second position. In such a case, an electric power is supplied from the movable contact 1162 to the motor and accordingly only the inner blade assembly 1103 is driven.

Figure 33:
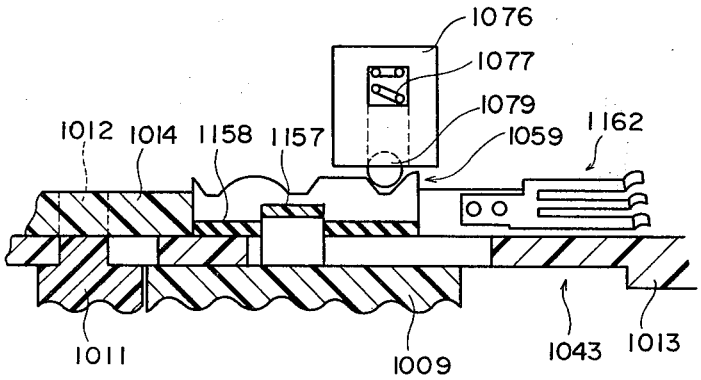

In the case where shaving is to be performed using the trimmer blade assembly 1007, the switch plate 1009 is raised to the upper most position, i.e. the third position as shown in FIG. 33. Accordingly, the trimmer lever operating plate 1014 is also raised upward by the upper end of the switch base plate 1158 moving integrally with the switch plate 1009. Then, as shown in FIG. 30, the trimmer blade assembly 1007 is protruded outward of the housing by means of the trimmer lever 1127.

When the switch plate 1009 is depressed downward from the state as shown in FIG. 33 to the state as shown in FIG. 32 or 31, the force having acted upon the trimmer operation plate 1011 and thus the trimmer lever operating plate 1014 is removed, whereby the trimmer blade assembly 1007 is retracted toward the housing.

The trimmer blade assembly 1007 can be protruded outward of the housing, while the switch plate 1009 is kept in the state shown in FIG. 31, i.e. a power supply to the motor is maintained interrupted. This is an essential feature of the embodiment shown. More specifically, the trimmer operation plate 1011 can be slid independently of the switch plate 1009. Accordingly, when only the trimmer operation plate 1011 is raised upward (in the arrow M direction in FIG. 25) in the state shown in FIG. 31, the trimmer lever 1127 is raised upward by the protrusion 1018 (FIG. 30) of the trimmer lever operating plate 1014 displacing integrally with the trimmer operation plate 1011, as described previously. Accordingly, in such a case as well, the trimmer blade assembly 1007 is protruded outward of the housing. In such a state, no electric power is supplied to the motor and the driver 1091 is not driven. Therefore, in such a state, the hair dust attached to the trimmer blade assembly 1007 can be cleaned using a brush, with the movable blade 1117 of the trimmer blade assembly 1007 kept in a rest or intact state.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An electric shaver, comprising:

a housing, an outer blade frame mounted to the upper end of said housing, an outer blade holding means for detachably holding said outer blade frame, an outer blade mounted to said outer blade frame, inner blade means disposed inside said outer blade frame for cooperating with said outer blade, a motor being housed within said housing, a power supply for supplying an electric power to said motor, first coupling means for coupling said motor and said inner blade means for imparting a reciprocating movement to said inner blade means, trimmer blade means supported by said housing and provided to selectively assume a first state thereof being retracted toward said housing or a second state thereof being protruded outward of said housing, displacement means coupled to said trimmer blade means in said housing and to be displaceable to a first position for placing said trimmer blade means to said first state or a second position for placing said trimmer blade means to said second state, second coupling means for coupling said motor and said trimmer blade means for imparting a reciprocating movement to said trimmer blade means on the occasion of said second state of said trimmer blade means, first operation means provided to be operable from outside said housing to be capable of selectively assuming a first, second and third positions, switching means associated with said first operation means for supplying an electric power from said power supply to said motor only at said second and third positions of said first operation means, first acting means associated with said switching means for acting upon said displacement means in association with displacement of said first operation means to said third position for displacing said displacement means to said second position, and second operation means provided independently of said first operation means to be operable from outside said housing for acting upon said displacement means for displacing said displacement means to said second position independently of said first acting means.

2. An electric shaver in accordance with claim 1, wherein said second operation means comprises an operation portion being exposed outside said housing, and second acting means responsive to said operation of said second operation means for acting upon said displacement means for displacing said displacement means to said second position.

3. An electric shaver in accordance with claim 1 or 2, which further comprises return means provided associated with said displacement means for returning said displacement means to said first position when no force is imparted to said displacement means.

4. An electric shaver in accordance with claim 1, which further comprises third coupling means for associatedly coupling said outer blade frame holding means and said second operation means, whereby said outer blade frame is removable from said housing when said second operation means is operated.

5. An electric shaver in accordance with claim 4, wherein a recess is formed on the inner wall of said outer blade frame, and said outer blade frame holding means comprises a protruding portion being fitted into said recess of said outer blade frame, and urging means for urging said protruding portion in a protruding direction.

6. An electric shaver in accordance with claim 4, wherein said third coupling means comprises directional displacement mitigating means for mitigating a displacement force in the direction from said outer blade frame holding means toward said second operation means.

7. An electric shaver in accordance with claim 4, wherein a recess is formed on the inner wall of said outer blade frame, said outer blade frame holding means comprises a protruding portion being fitted into said recess of said outer blade frame, said protruding portion is formed integrally of said second operation means, said directional displacement force mitigating means comprises a coupling portion for integrally coupling said second operation means and said protruding portion, said coupling portion is formed with a plate member narrower than other portions, whereby a force being exerted upon said second operation means is transferred as a displacement force to said protruding portion, while a force being exerted upon said protruding portion is mitigated by said narrow plate portion.

8. An electric shaver in accordance with claim 1, wherein said displacement means comprises a first portion coupled to said trimmer blade means at one end and receiving a force from said second operation means at the other end, said second operation means comprises a second portion acting upon said first portion, and said displacement means is responsive to operation of said operation means to said second position upon application of a force through said second portion and said first portion.

9. An electric shaver in accordance with claim 8, wherein said first portion and said second portion has oblique surfaces oblique in the direction opposite to each other, said two oblique surfaces being in face contact with each other, the oblique surface of said first portion moves along the oblique surface of said second portion when the oblique surface of said second portion is displaced responsive to operation of said second operation means, whereby said displacement means is brought to said second position.

10. An electric shaver in accordance with claim 1, wherein said switching means comprises an elongated displacement member the length direction of which is in parallel with the displacement direction of said first operation means, a contact member provided at the lower end of said displacement member for supplying an electric power from said power supply to said motor, and an abutting portion formed at the upper end of said displacement member for displacing said displacement means to said second position when said first operation means is at said third position.

* * * * *